US007825861B2

(12) United States Patent
Sato et al.

(10) Patent No.: US 7,825,861 B2
(45) Date of Patent: Nov. 2, 2010

(54) RADIO MODULE

(75) Inventors: Koichi Sato, Tachikawa (JP); Yusuke Miura, Hachioji (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 780 days.

(21) Appl. No.: 11/825,066

(22) Filed: Jul. 3, 2007

(65) Prior Publication Data

US 2008/0007468 A1 Jan. 10, 2008

(30) Foreign Application Priority Data

Jul. 7, 2006 (JP) ..... 2006-188578

(51) Int. Cl.
*H01Q 1/24* (2006.01)

(52) U.S. Cl. ..... 343/702

(58) Field of Classification Search ..... 343/702, 343/700 MS, 845–846, 829, 833–834; 455/550.1
See application file for complete search history.

(56) References Cited

U.S. PATENT DOCUMENTS

| | | | | |
|---|---|---|---|---|
| 6,211,830 | B1 * | 4/2001 | Monma et al. | 343/702 |
| 6,507,318 | B2 * | 1/2003 | Ito et al. | 343/702 |
| 6,563,467 | B1 * | 5/2003 | Buris et al. | 343/702 |
| 6,697,025 | B2 * | 2/2004 | Koyanagi et al. | 343/741 |
| 6,947,000 | B2 | 9/2005 | Ito | |
| 6,985,113 | B2 * | 1/2006 | Nishimura et al. | 343/702 |
| 7,002,521 | B2 * | 2/2006 | Egawa et al. | 343/702 |
| 7,342,541 | B2 | 3/2008 | Harano | |
| 7,456,795 | B2 * | 11/2008 | Chiba et al. | 343/702 |
| 2003/0169206 | A1 | 9/2003 | Egawa | |
| 2005/0219129 | A1 | 10/2005 | Harano | |
| 2006/0028380 | A1 | 2/2006 | Harano | |

FOREIGN PATENT DOCUMENTS

| | | | |
|---|---|---|---|
| JP | 2000-40910 | A | 2/2000 |
| JP | 2000-049520 | A | 2/2000 |
| JP | 2000-315909 | A | 11/2000 |
| JP | 2002-094311 | A | 3/2002 |
| JP | 2002-353719 | A | 12/2002 |

(Continued)

OTHER PUBLICATIONS

Japanese Office Action (and English translation thereof) dated Mar. 25, 2008, issued in a counterpart Japanese Application.

(Continued)

*Primary Examiner*—Huedung Mancuso
(74) *Attorney, Agent, or Firm*—Holtz, Holtz, Goodman & Chick, PC

(57) ABSTRACT

A conductor is mounted on a circuit board parallel to its side along which a radiation of a radio frequency signal is generated. The proximal end of the L-shaped conductor is electrically connected to a ground pattern formed on the rear surface of a circuit board 1, and the distal end of the L-shaped conductor is open. The position at which the conductor is connected to the ground pattern is set to be a position spaced apart by a quarter-wavelength of a radio-frequency signal from a feed point of an antenna. The total length of the conductor is set to be a half-wavelength of the radio-frequency signal.

17 Claims, 24 Drawing Sheets

FOREIGN PATENT DOCUMENTS

| | | | |
|---|---|---|---|
| JP | 2003-060417 | A | 2/2003 |
| JP | 2003-198410 | A | 7/2003 |
| JP | 2003-283238 | A | 10/2003 |
| JP | 2004-007243 | A | 1/2004 |
| JP | 2004-032808 | A | 1/2004 |
| JP | 2005-150998 | A | 6/2005 |
| JP | 2005-522063 | A | 7/2005 |
| JP | 2005-286895 | A | 10/2005 |
| JP | 2006-033798 | A | 2/2006 |
| JP | 2006-050496 | A | 2/2006 |
| JP | 2006-086715 | A | 3/2006 |
| WO | WO 2004/042947 | A1 | 5/2004 |

OTHER PUBLICATIONS

Japanese Office Action (and English translation thereof) dated Jun. 17, 2008, issued in a counterpart Japanese Application.

* cited by examiner ( With conductor )

RADIO MODULE

CROSS-REFERENCE TO RELATED APPLICATIONS

This application is based upon and claims the benefit of priority from prior Japanese Patent Application No. 2006-188578, filed Jul. 7, 2006, the entire contents of which are incorporated herein by reference.

BACKGROUND OF THE INVENTION

1. Field of the Invention

The present invention relates to a radio module having an antenna and, more particularly, to a radio module installed in a radio communication terminal such as a cellular phone, PDA (Personal Digital Assistants), cordless phone, or transceiver which is used in contact with or close to a user.

2. Description of the Related Art

Recently, in a mobile communication terminal represented by a cellular phone, a built-in antenna accommodated in a housing is mainly used. However, since such built-in antenna is arranged close to the ground pattern of a circuit board accommodated in the housing, the impedance and bandwidth obviously decrease. Also, when using a monopole antenna, a radiation pattern varies in accordance with the size of the ground pattern of the circuit board, thus posing a problem.

In order to improve the radiation pattern of an antenna, an arrangement has been proposed (e.g., see Jpn. Pat. Appln. KOKAI Publication No. 2000-40910) in which, e.g., an L-shaped long plate with one end connected to the ground surface of a circuit board is located on this ground surface, and a current flowing to the ground pattern of the circuit board is reduced by using this plate, thereby reducing degradation of directivity characteristics.

However, as is apparent from FIGS. 1 to 4 in Jpn. Pat. Appln. KOKAI Publication No. 2000-40910, in the conventionally proposed arrangement, the L-shaped plate is located on a circuit board surface close to a user's head. Accordingly, since the L-shaped plate is also close to the user's head, this module tends to be influenced by the user, and the improvement effect of the radiation characteristics of the antenna decreases. On the circuit board surface facing the user, a key pad and various circuit components are mounted at high density. Hence, when the L-shaped plate is located on the circuit board surface facing the user, the circuit board must become large, and this leads to an increase in size and cost of the terminal.

BRIEF SUMMARY OF THE INVENTION

It is an object of the present invention to provide a radio module capable of improving impedance characteristics and radiation characteristics, and widening the bandwidth without increasing the size of a terminal.

In order to achieve the above object, according to the first aspect of the present invention, in a radio module in which a radio circuit is mounted on a circuit board having a ground pattern, an antenna is connected to the radio circuit, and a conductor is located at a position facing a second surface opposing a first surface facing a user during speech communication or a side surface, along a side of the circuit board, in which a radiation of a radio frequency signal is generated. A proximal end of the conductor is connected to the ground pattern at or near a position spaced apart by a quarter-wavelength of a radio-frequency signal from a connection point between the radio circuit and the antenna.

With this arrangement, a current flowing on the ground pattern along the side of the circuit board, in which a radiation of a radio frequency signal is generated, during use of the antenna is partially shunted to the conductor at or near a position spaced apart by a quarter-wavelength from the connection point between the radio circuit and the antenna, i.e., the feed point. This makes it possible to effectively flow a current flowing to the ground pattern of the circuit board to the conductor at a position where the current value is maximum. This can improve the radiation characteristics of the antenna. Since the conductor appears open from the viewpoint of the feed point, the impedance can be increased. When the current flowing on the ground pattern along the side of the circuit board, in which a radiation of a radio frequency signal is generated, is partially shunted to the conductor, a plurality of resonance modes can be generated to widen the bandwidth.

The conductor is located on a circuit board surface opposing the circuit board surface facing the user during speech communication or on a side surface. The influence of the user on the conductor can be reduced as compared with the case in which the conductor is located on the circuit board surface facing the user. The circuit board surface facing the user during speech communication generally has a narrow mounting space but does not have the conductor, thereby preventing an increase in size of the terminal.

According to the second aspect of the present invention, in a radio module in which a radio circuit is mounted on a circuit board having a ground pattern, an antenna is connected to the radio circuit, and a conductor is located at a position facing a second surface opposing a first surface facing a user during speech communication or a side surface, along a side of the circuit board, in which a radiation of a radio frequency signal is generated. A distal end of the conductor is open, and a proximal end of the conductor is connected to the ground pattern at a position at which an effective electrical length from a connection point between the radio circuit and the antenna to the distal end is set to be a half-wavelength of a radio-frequency signal by the antenna or a value in the neighborhood of the half-wavelength.

With this arrangement, similar to the first aspect, a current flowing on the ground pattern along the radiation of a radio frequency signal generation side of the circuit board during use of the antenna is partially shunted to the conductor. This can improve the radiation characteristics of the antenna. The effective electrical length between the feed point and the distal end of the conductor is set to be a half-wavelength of a radio-frequency signal or a value in the neighborhood of it. Hence, the conductor appears open from the viewpoint of the feed point, and the input impedance can be increased. When the current flowing on the ground pattern along the side of the circuit board, in which a radiation of a radio frequency signal is generated, is partially shunted to the conductor, a plurality of resonance modes can be generated to widen the bandwidth. Additionally, similar to the first aspect, when the conductor is located on a circuit board surface opposing the circuit board surface facing the user during speech communication or a side surface, the influence of the user on the conductor can be reduced, thereby preventing an increase in size of the terminal.

According to the third aspect of the present invention, in a radio module in which a first radio circuit operating in a first period and a second radio circuit operating in a second period different from the first period are mounted on a circuit board having a ground pattern, a first antenna is connected to the first radio circuit, and a second antenna is located at a position facing a second surface opposing a first surface facing a user during speech communication or a side surface, along a side in the first period of the circuit board, in which a radiation of a radio frequency signal is generated. A connection switching circuit is located between the second radio circuit and the second antenna. The connection switching circuit connects, in the second period, the second antenna with the second radio circuit, and connects, in the first period, the second antenna to the ground pattern at or near a position spaced apart by a quarter-wavelength of a radio-frequency signal by the first antenna from a connection point between the first radio circuit and the first antenna.

With this arrangement, the following effects can be obtained in addition to the effects obtained according to the first and second aspects. That is, the second antenna to be used for another communication operation can be used as a conductor in radio communication of the first antenna. As a result, a conductor need not be additionally located, thereby preventing an increase in size of the radio module and an increase in mounting density.

Accordingly, the present invention can provide a radio module capable of improving the impedance characteristics and radiation characteristics, and widening the bandwidth without increasing the size of the terminal.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

First Embodiment

Figure 1:
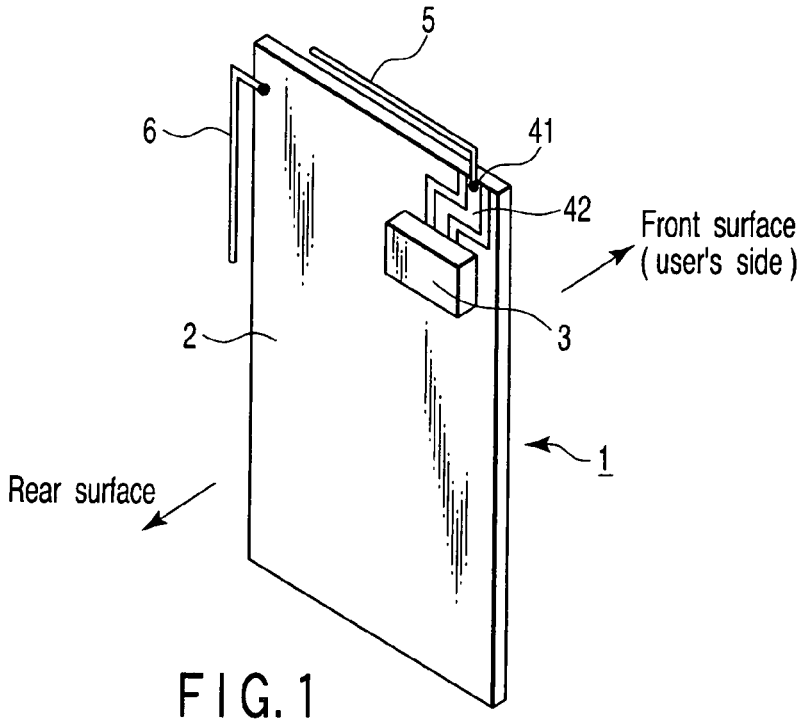
FIG. 1 is a perspective view showing the arrangement of a radio module according to the first embodiment of the present invention.

FIG. 1 is a perspective view showing the arrangement of a radio module for a portable terminal according to the first embodiment of the present invention.

The radio module is accommodated between the front cover and rear case (both not shown) of a housing of the portable terminal. In this accommodation state, a "front surface" side shown in FIG. 1 is set as a front cover side, i.e., the side facing a user's head during speech communication, and a "rear surface" side shown in FIG. 1 is set as a rear case side.

The radio module includes a circuit board 1. The circuit board 1 comprises a double-sided printed wiring board having printed wiring patterns on the front and rear surfaces, and a radio circuit 3 is mounted on the rear surface. Additionally, an antenna connection terminal 41 and a signal line pattern 42 which connects this antenna connection terminal with the radio circuit 3 are formed on the rear surface of the circuit board 1, and an antenna 5 is connected to the antenna connection terminal 41. The antenna 5 is connected by, e.g., soldering or spring connection. The total length of the L-shaped antenna 5 is set to be an effective electrical length corresponding to a quarter-wavelength of the radio-frequency signal.

A ground pattern 2 is formed on almost the entire rear surface of the circuit board 1 except for the portion of the signal line pattern 42. Note that when the circuit board 1 comprises a multi-layered board, most ground patterns are formed on the second and third layers. In this case, the ground pattern is partially formed on the rear surface of the circuit board 1. A shield cap (not shown) is mounted on the radio circuit 3 to electromagnetically shield the internal space of the radio circuit 3 from the outside.

Figure 2:
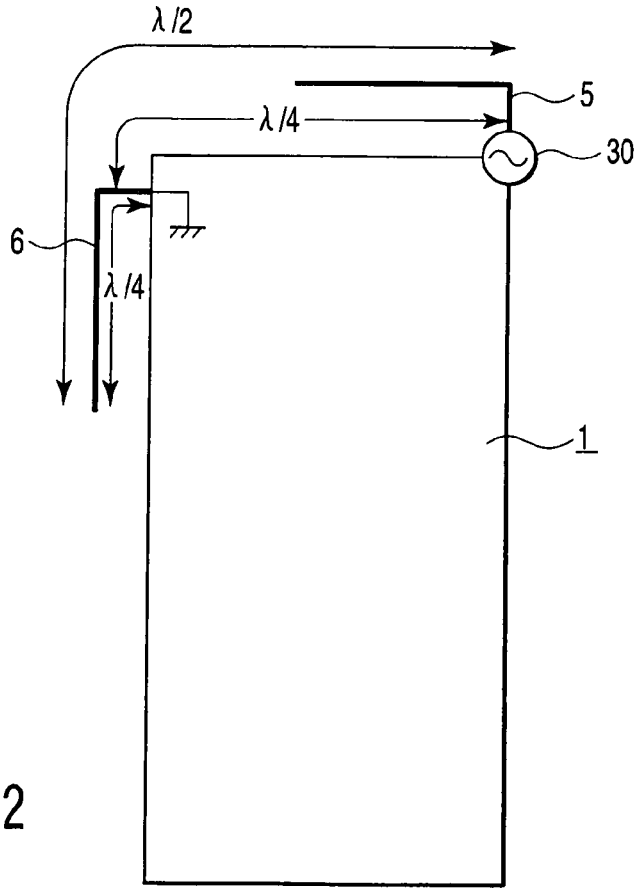
FIG. 2 is a view for explaining the ground position of a conductor and the length of the module in the radio module shown in FIG. 1.

Note that a conductor 6 is located almost parallel to that side of the circuit board 1, in which a radiation of a radio frequency signal (main polarized wave) is generated (this side will be referred to as the "radiation of a radio frequency signal generation side" hereinafter). The proximal end of the L-shaped conductor 6 is electrically connected to the ground pattern 2 formed on the rear surface of the circuit board 1, and the distal end of the conductor 6 is open. As shown in FIG. 2, the position at which the conductor 6 is connected to the ground pattern 2 is spaced apart by a quarter-wavelength ($\lambda/4$) of the radio-frequency signal from the connection point between the antenna connection terminal 41 and the antenna 5, i.e., a feed point 30. The total length of the conductor 6 is set to be the quarter-wavelength ($\lambda/4$) of the radio-frequency signal. That is, the effective electrical length between the feed point 30 of the antenna 5 and the distal end of the conductor 6 is set to be a half-wavelength ($\lambda/2$) of the radio-frequency signal.

With this arrangement in radio transmission, a high-frequency current which conventionally flows to the ground pattern 2 along the radiation of a radio frequency signal generation side of the circuit board 1 partially flows to the conductor 6, thereby reducing the high-frequency current flowing to the ground pattern 2. That is, the polarized wave component of the radio wave which flows in the longitudinal direction of the board is canceled, and the radiation characteristics are hardly influenced by the size of the circuit board 1.

Figure 3:
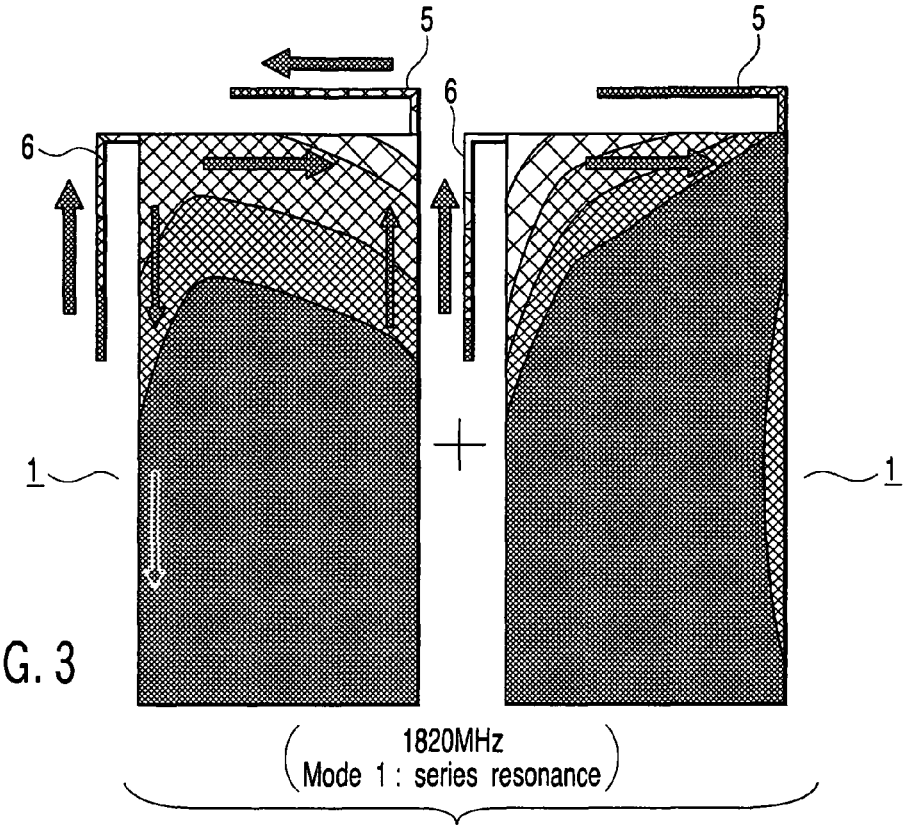
FIG. 3 is a view showing the first example of a current distribution and strength on a circuit board when a series resonant mode is generated at a frequency of 1,820 MHz in the radio module shown in FIG. 1.
Figure 4:
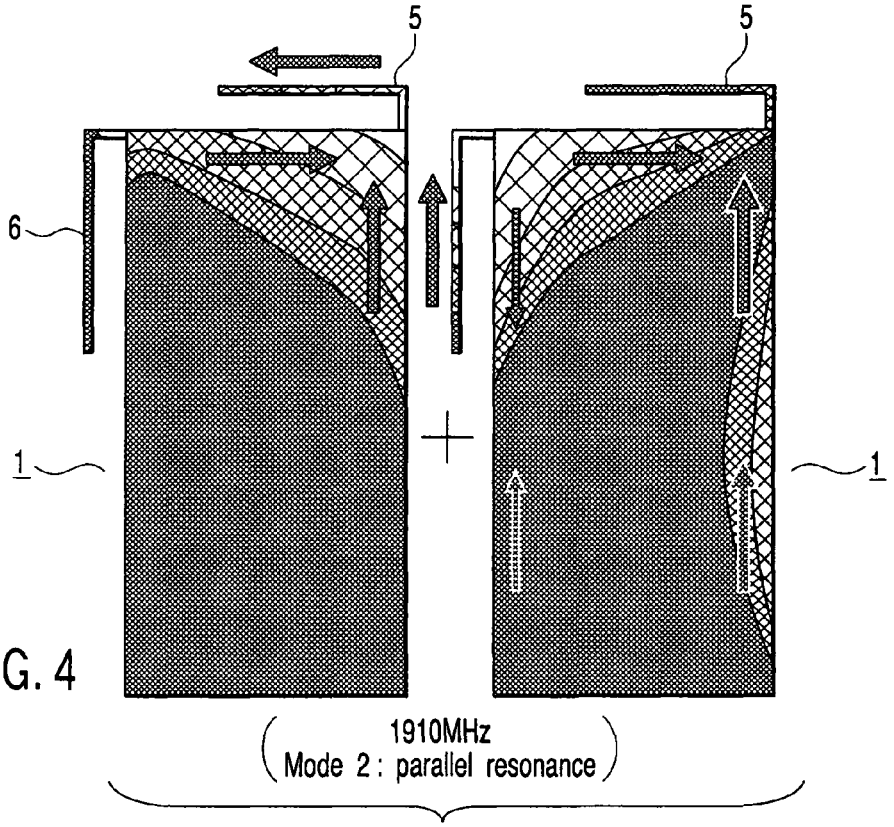
FIG. 4 is a view showing the first example of a current distribution and strength on the circuit board when a parallel resonant mode is generated at a frequency of 1,910 MHz in the radio module shown in FIG. 1.
Figure 5:
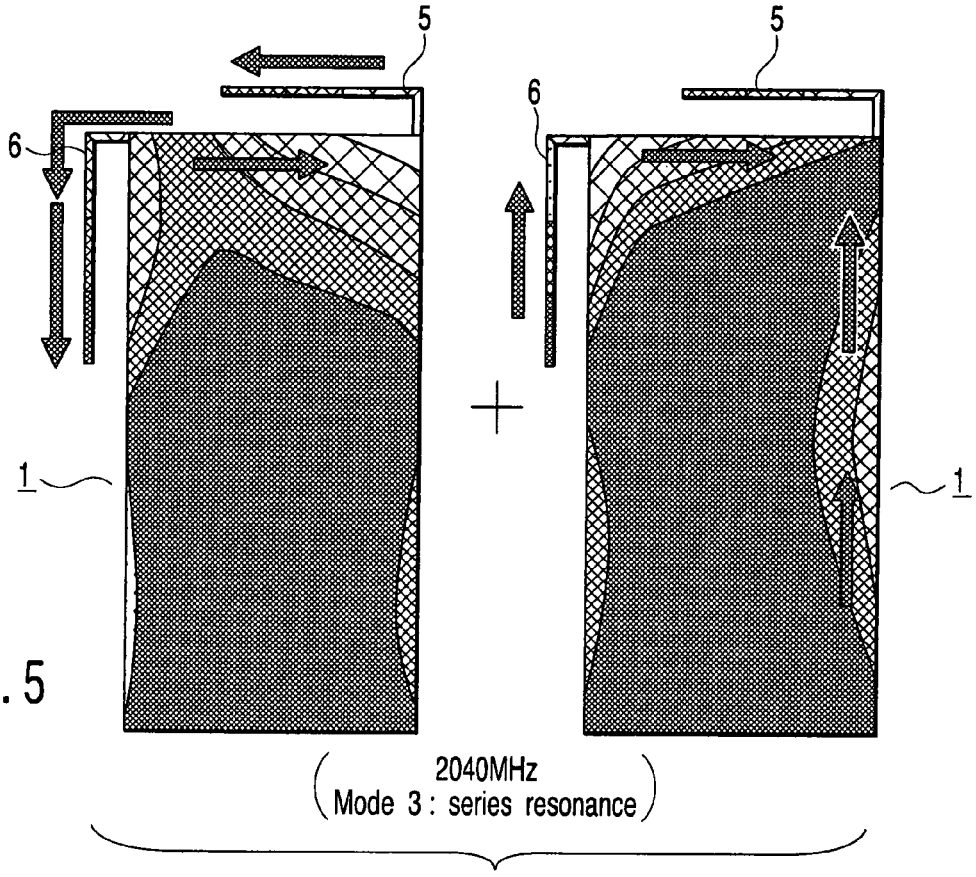
FIG. 5 is a view showing the first example of a current distribution and strength on the circuit board when a series resonant mode is generated at a frequency of 2,040 MHz in the radio module shown in FIG. 1.

FIGS. 3 to 5 show the current distributions and strengths on the circuit board 1 in correspondence with a plurality of resonant modes which is generated when the conductor 6 is located. FIGS. 3 to 5 respectively show a series resonant mode (mode 1) at a frequency of 1,820 MHz, a parallel resonant mode (mode 2) at a frequency of 1,910 MHz, and a series resonant mode (mode 3) at a frequency of 2,040 MHz. As is apparent from FIGS. 3 to 5, the high-frequency current flowing to the ground pattern 2 is partially shunted to the conductor 6. Hence, the high-frequency current flowing to the circuit board 1 is reduced, and this improves the radiation pattern.

Figure 7A:
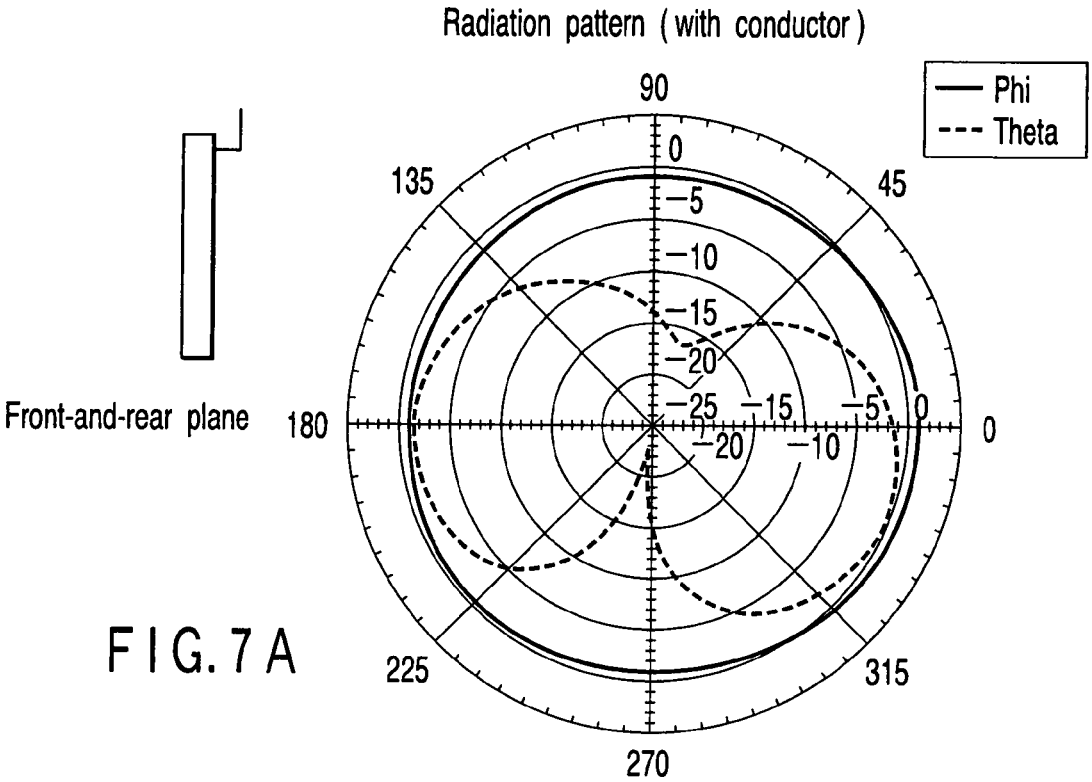
FIGS. 7A and 7B are views showing examples of radiation patterns generated by the radio module shown in FIG. 1.
Figure 7B:
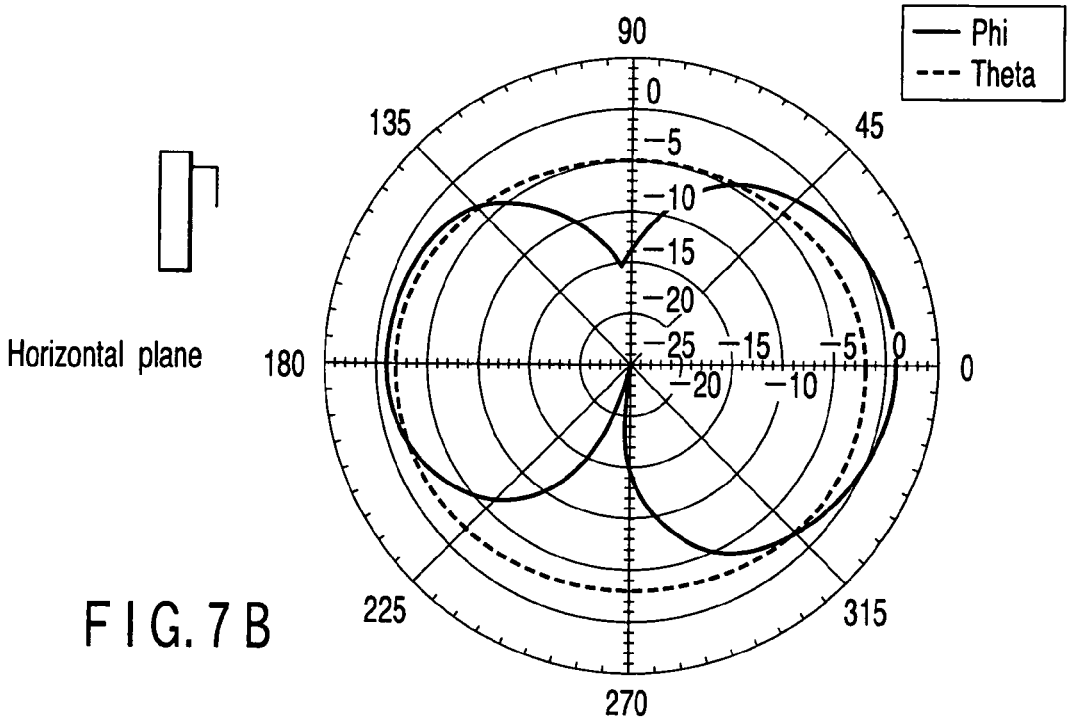
Figure 8A:
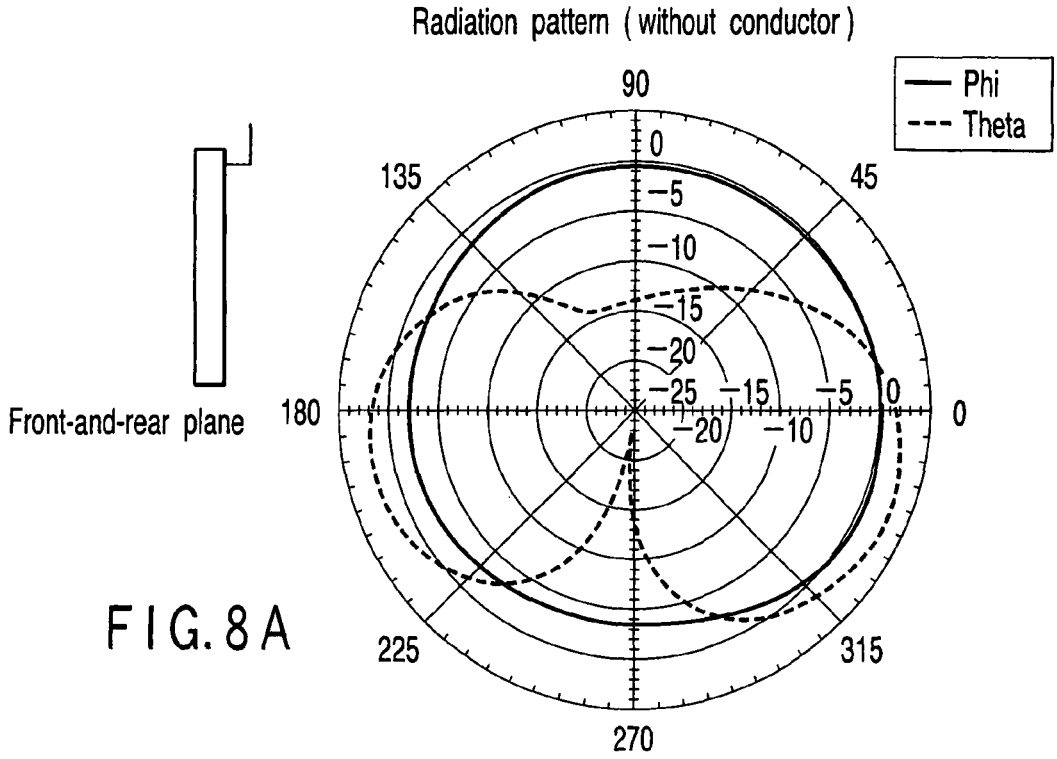
FIGS. 8A and 8B are views showing examples of radiation patterns obtained when the conductor is not mounted.
Figure 8B:
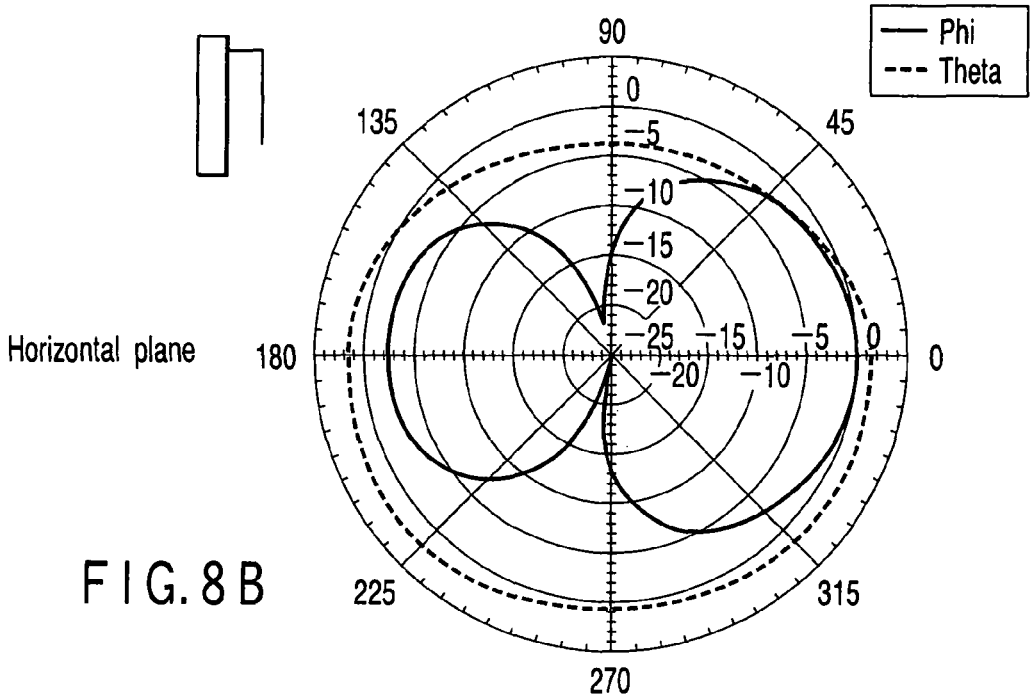

FIGS. 7A and 7B are views showing examples of radiation patterns obtained when the conductor 6 is mounted. FIGS. 7A and 7B respectively show radiation gains on the front-and-rear plane and horizontal plane of the circuit board 1. As is apparent from FIGS. 7A and 7B, when the conductor 6 is mounted, a vertically polarized wave component in the longitudinal direction of the board is canceled, thereby increasing a horizontally polarized wave component. As a result, the radiation characteristics improve as compared with a case in which the conductor is not mounted (to be described later) (FIGS. 8A and 8B). Accordingly, radiation to the user is suppressed, thereby improving efficiency in communication.

Figure 6:
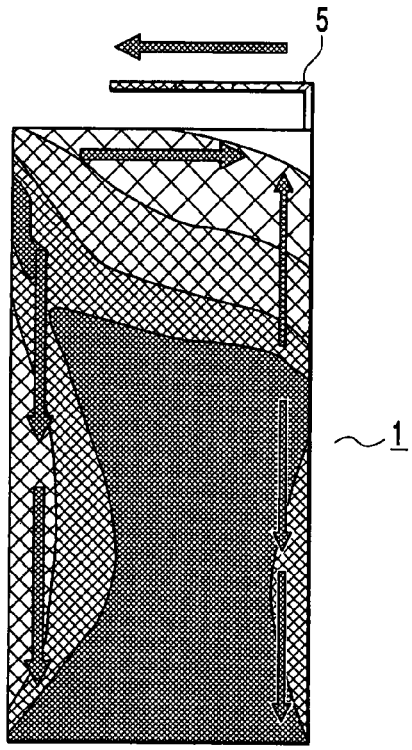
FIG. 6 is a view showing an example of a current distribution and strength on the circuit board when the conductor is not mounted.

FIG. 6 is a view showing a current distribution and its strength on the circuit board 1 when the conductor 6 is not mounted. A large high-frequency current flows along the radiation of a radio frequency signal generation side (the longitudinal side of the board) on the circuit board 1, and the radiation pattern is influenced by the high-frequency current flowing to the circuit board 1. FIGS. 8A and 8B are views showing examples of radiation patterns obtained when the conductor is not mounted. FIGS. 8A and 8B respectively show radiation gains on the front-and-rear plane and horizontal plane of the circuit board 1.

Figure 9:
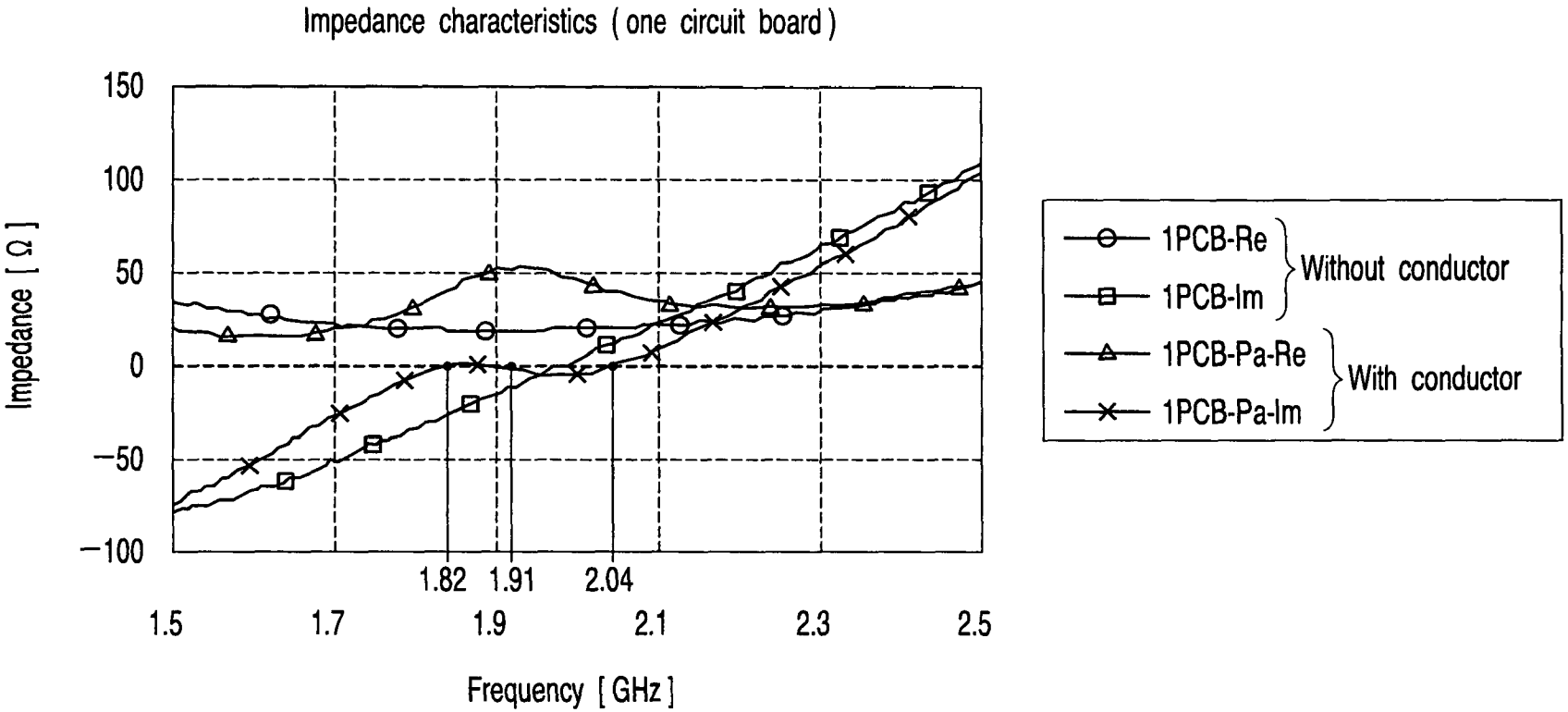
FIG. 9 is a graph showing an example of the impedance characteristics of the radio module shown in FIG. 1.

Since the conductor 6 serves as a stub from the viewpoint of the feed point, the impedance increases from the viewpoint of the feed point 30. FIG. 9 is a graph showing an example of a change in impedance as a function of frequency. With reference to FIG. 9, the impedance characteristics improve when the conductor 6 is mounted (1PCB-Pa-Re, 1PCB-Pa-Im) as compared with a case in which the conductor 6 is not mounted (1PCB-Re, 1PCB-Im).

Figure 10:
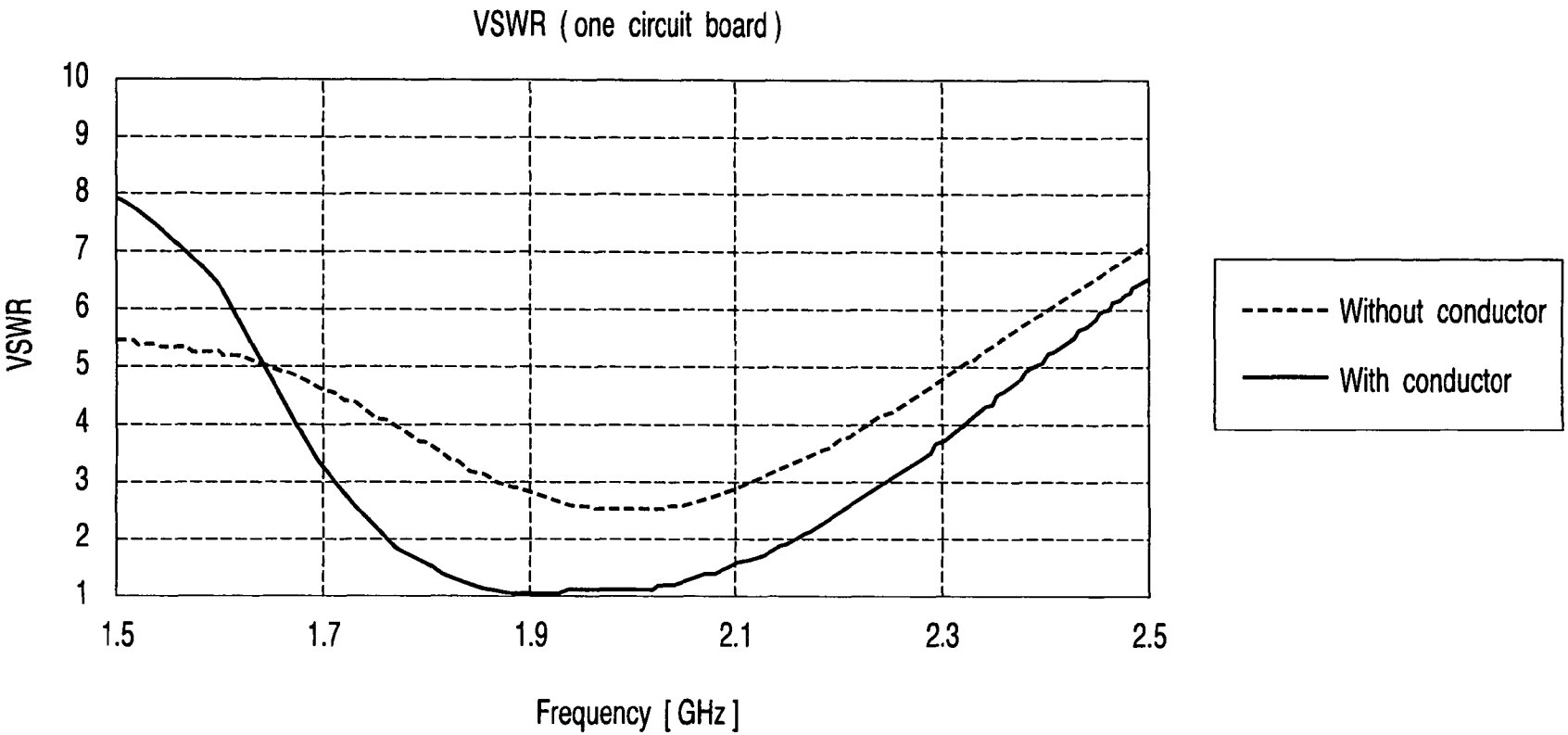
FIG. 10 is a graph showing an example of the VSWR characteristics of the radio module shown in FIG. 1.

Additionally, when the conductor 6 is mounted, a plurality of resonant modes (e.g., in FIG. 9, the series resonant mode at a frequency of 1,820 MHz, the parallel resonant mode at a frequency of 1,910 MHz, and the series resonant mode at a frequency of 2,040 MHz) are generated as shown in 1PCB-Pa-Im in FIG. 9. That is, the antenna becomes broadband. FIG. 10 is a graph showing an example of a change in the voltage standing wave ratio (VSWR) as a function of frequency. As is apparent from FIG. 10, the VSWR improves over a broader frequency band when the conductor 6 is mounted (solid line in FIG. 10) as compared with a case in which the conductor 6 is not mounted (broken line in FIG. 10).

Figure 11:
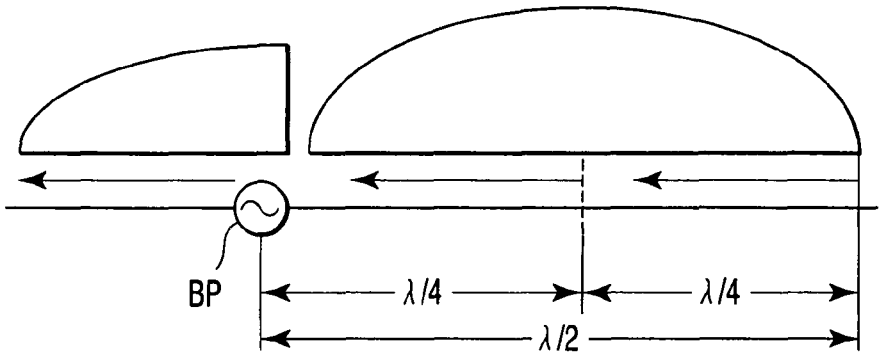
FIG. 11 is a view showing a current value on a radiation of a radio frequency signal generation side of the circuit board in the radio module shown in FIG. 1.
Figure 12:
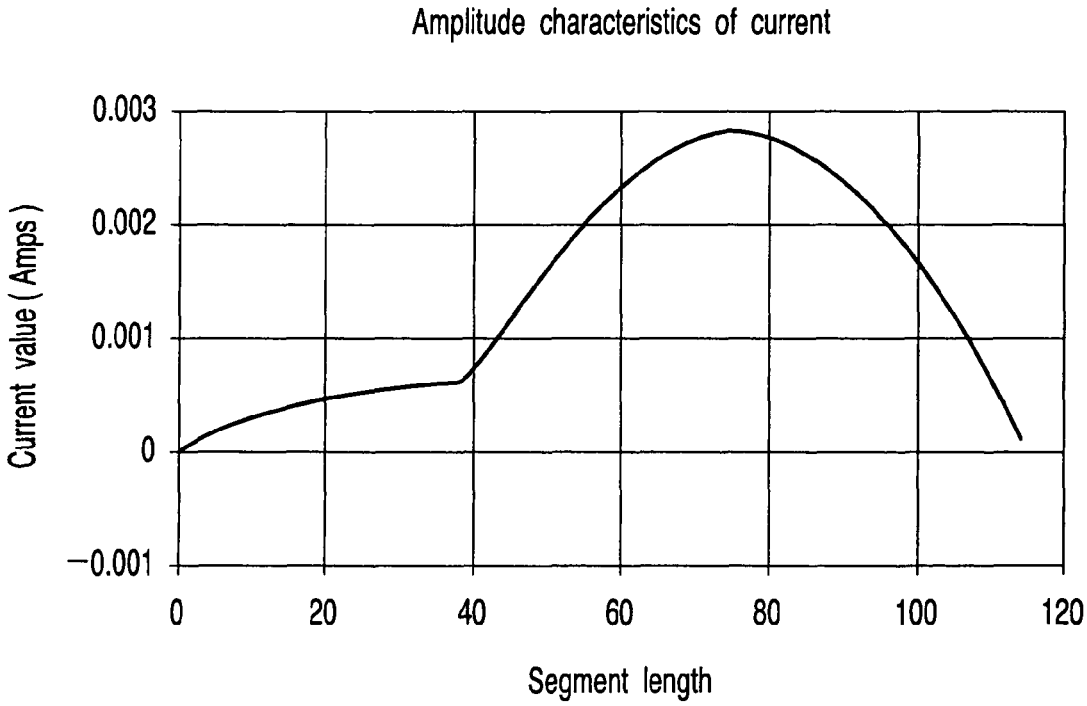
FIG. 12 is a graph showing the current value on the side of the circuit board, in which a radiation of a radio frequency signal is generated, in the radio module shown in FIG. 1.

In the first embodiment, the conductor 6 is connected to the ground pattern 2 at the position spaced apart by a quarter-wavelength of the radio-frequency signal from the feed point 30 on the radiation of a radio frequency signal generation side of the circuit board 1. That is, as shown in FIGS. 11 and 12, the conductor 6 is connected to the ground pattern 2 at a position where the current value is maximum on the ground pattern 2. Hence, the high-frequency current flowing on the ground pattern 2 along the radiation of a radio frequency signal generation side of the circuit board 1 can flow to the conductor 6 most efficiently. As a result, a plurality of resonant modes are easily generated, and the antenna becomes broadband more effectively.

The length between the feed point 30 and the distal end of the conductor 6 is set to be a half-wavelength of the radio-frequency signal. Note that, as is apparent from FIG. 11, the position spaced by a half-wavelength from the feed point 30 is a position where the high-frequency current value is minimum. Hence, the impedance becomes highest from the viewpoint of the feed point, and the impedance characteristics can be improved most effectively.

Furthermore, the conductor 6 is mounted on the side surface of the board along the radiation of a radio frequency signal generation side of the circuit board 1, and the proximal end of the conductor 6 is connected to the ground pattern 2 on the rear surface side of the circuit board 1. That is, the conductor 6 is mounted on the surface of the circuit board 1 opposing the surface facing the user during speech communication. Accordingly, the influence of the user on the conductor can be reduced as compared with the case in which the conductor 6 is mounted on the surface of the circuit board 1 facing the user. Note that the surface of the circuit board 1 facing the user during speech communication generally has a narrow mounting space. However, the conductor 6 is not mounted on this circuit component mounting surface, thereby preventing an increase in size of the terminal.

That is, the impedance characteristics and radiation characteristics can be improved, and the bandwidth can be widened most efficiently without increasing the size of the terminal.

Second Embodiment

According to the second embodiment of the present invention, in a radio module such as a radio module installed in a foldable portable terminal in which two circuit board units are connected via a flexible cable or thin coaxial cable, a conductor is grounded on a radiation of a radio frequency signal generation side of the circuit board unit on which a radio circuit and an antenna are mounted, on the extension line of the position of a connector of the cable from the viewpoint of a feed point.

Figure 13:
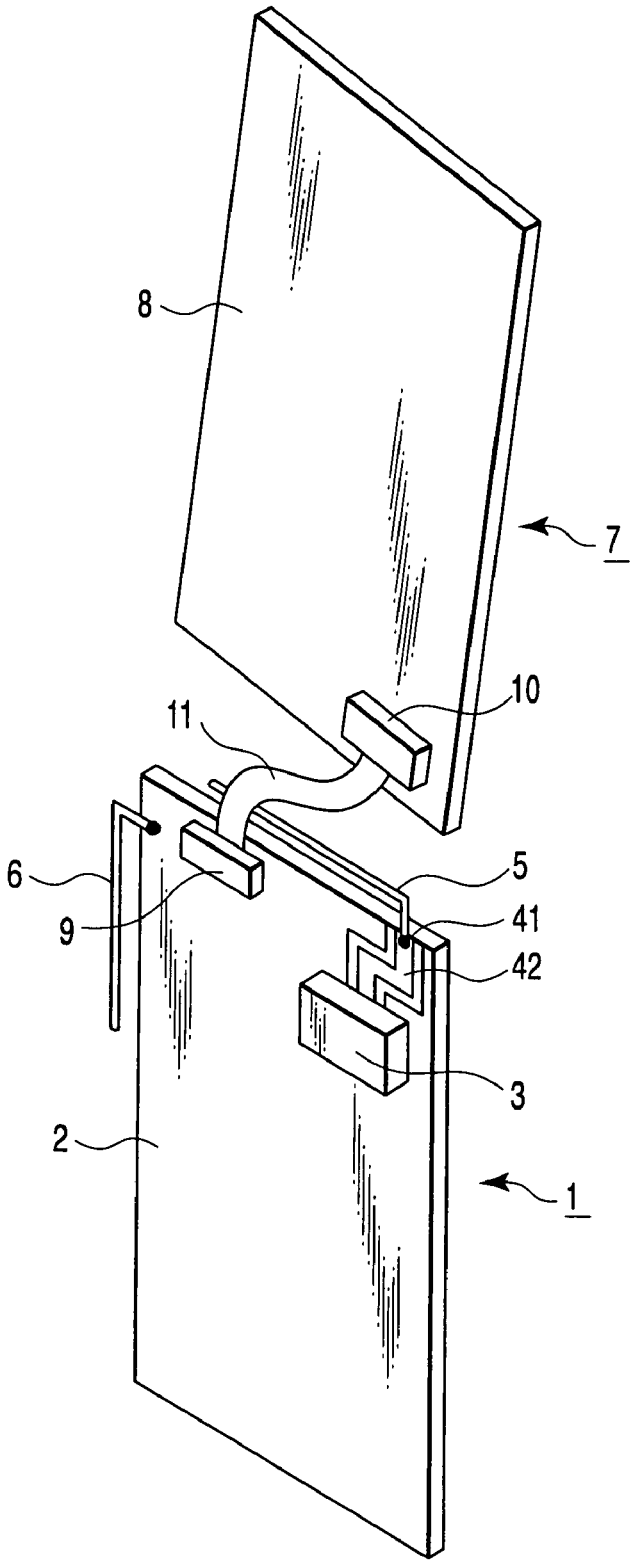
FIG. 13 is a perspective view showing the arrangement of a radio module according to the second embodiment of the present invention.

FIG. 13 is a perspective view showing the arrangement of the radio module according to the second embodiment of the present invention. Note that the same reference numbers as shown in FIG. 1 denote the same parts in FIG. 13. In the radio module according to this embodiment, a first circuit board 1 accommodated in a lower housing and a second circuit board 7 accommodated in an upper housing are connected to each other via a cable 11 and connectors 9 and 10. The connector 9 is located on a radiation of a radio frequency signal generation side of the circuit board 1. Note that on a rigid board on which the board is integrated with the flexible cable, no connector is mounted, and the cable is directly connected to the board.

In the second embodiment, a conductor 6 is also mounted parallel to a radiation of a radio frequency signal (main polarized wave) generation side on the circuit board 1. The proximal end of the L-shaped conductor 6 is electrically connected to a ground pattern 2 formed on the rear surface of the circuit board 1, and the distal end of the conductor 6 is open. The position at which the conductor 6 is connected to the ground pattern 2 is on the extension line of the position of the connector 9 of the cable 11 from the viewpoint of the connection point between an antenna connection terminal 41 and an antenna 5, i.e., a feed point, and spaced apart by a quarter-wavelength ($\lambda/4$) of the radio-frequency signal from the feed point. The total length of the conductor 6 is set to be a quarter-wavelength ($\lambda/4$) of the radio-frequency signal.

With this arrangement during use of the antenna, a high-frequency current which conventionally flows to the ground pattern 2 along the radiation of a radio frequency signal generation side of the circuit board 1 partially flows to the conductor 6, thereby reducing the high-frequency current flowing to the ground pattern 2 of the circuit board 1. At the same time, the high-frequency current flowing to the ground pattern of the circuit board 7 from the ground pattern 2 of the circuit board 1 via the connector 9 and the cable 11 is also reduced.

Figure 14:
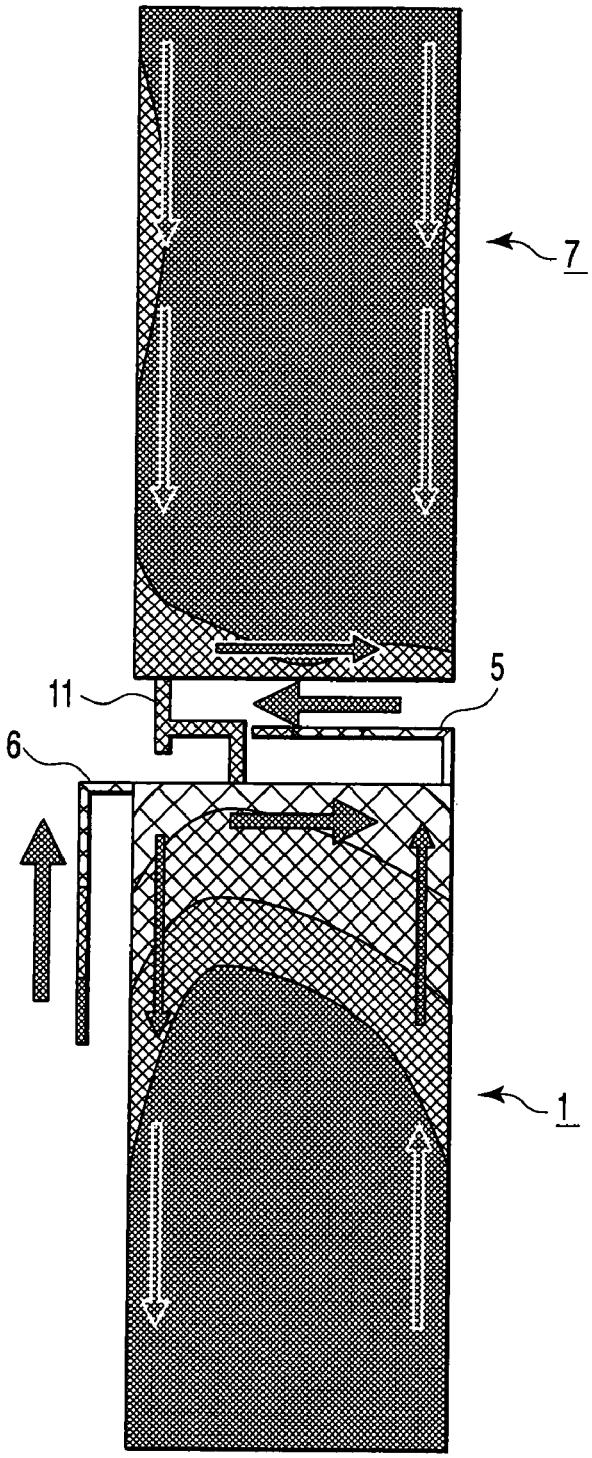
FIG. 14 is a view showing an example of current distributions and strengths on circuit boards in the radio module shown in FIG. 13.
Figure 15:
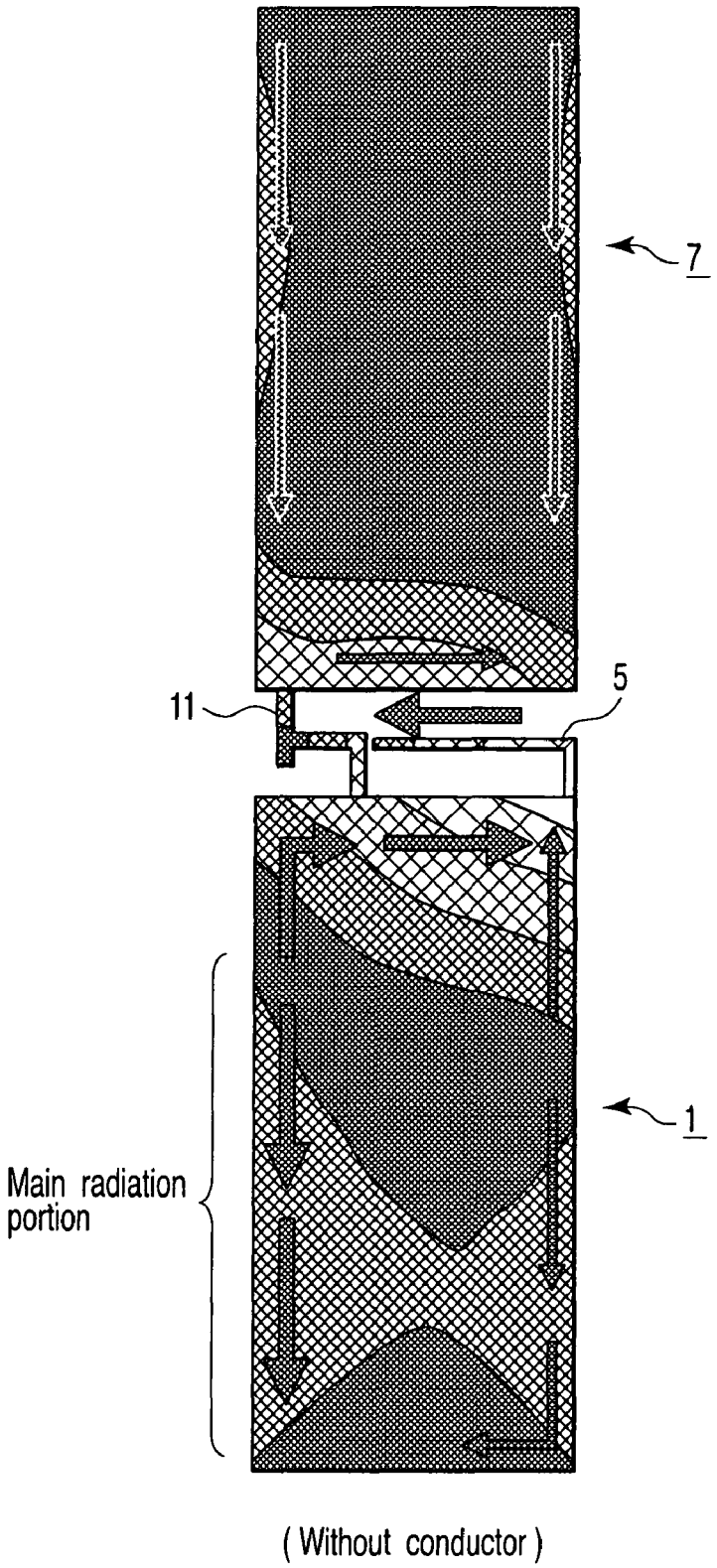
FIG. 15 is a view showing an example of current distributions and strengths on the circuit boards when a conductor is not located.

FIG. 14 is a view showing current distributions and strengths on the circuit boards 1 and 7 when the conductor 6 is mounted. Note that FIG. 14 shows a state wherein a resonant frequency is 1,950 MHz. FIG. 15 is a view showing current distributions and strengths when the conductor 6 is not mounted. As is apparent from FIG. 15, the spread of the current distribution to the circuit board 7 can be suppressed, not to mention the spread of the current distribution to the circuit board 1, when the conductor 6 is mounted, as compared with the case in which the conductor 6 is not mounted.

When the conductor 6 is mounted, the polarized wave component in the longitudinal direction of the circuit board 1 is canceled by the current generated by the conductor 6, thereby preventing degradation of the radiation characteristics in accordance with the size of the circuit board 1. Additionally, the direction of the horizontally polarized wave component of the antenna 5 has reverse phase to that of the circuit board 1 in a circuit board thickness direction, thereby reducing the radiation gain in the forward direction. Accordingly, radiation toward the user is reduced, thereby suppressing a decrease in antenna gain by the user during speech communication. Note that when the conductor 6 is not mounted, the radiation of a radio frequency signal changes depending on the current flowing on the side opposite to the feed point of the circuit board 1, and the vertically polarized wave component serves as a main component.

Figure 16A:
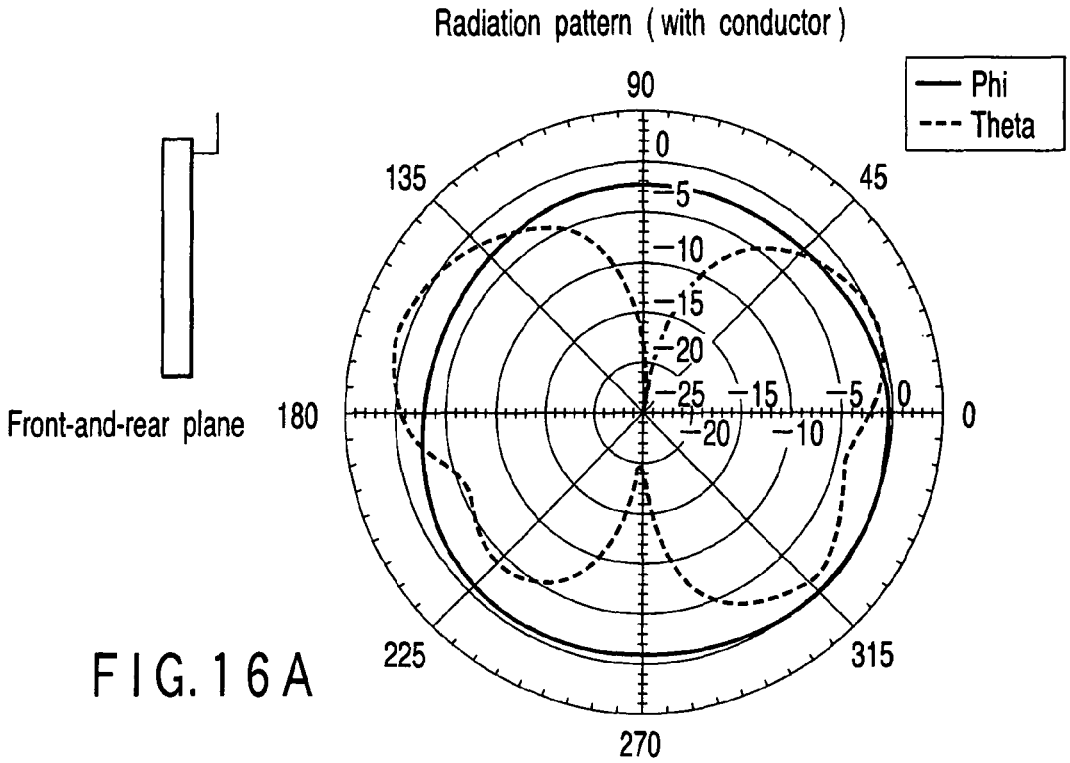
FIGS. 16A and 16B are views showing examples of radiation patterns generated by the radio module shown in FIG. 13.
Figure 16B:
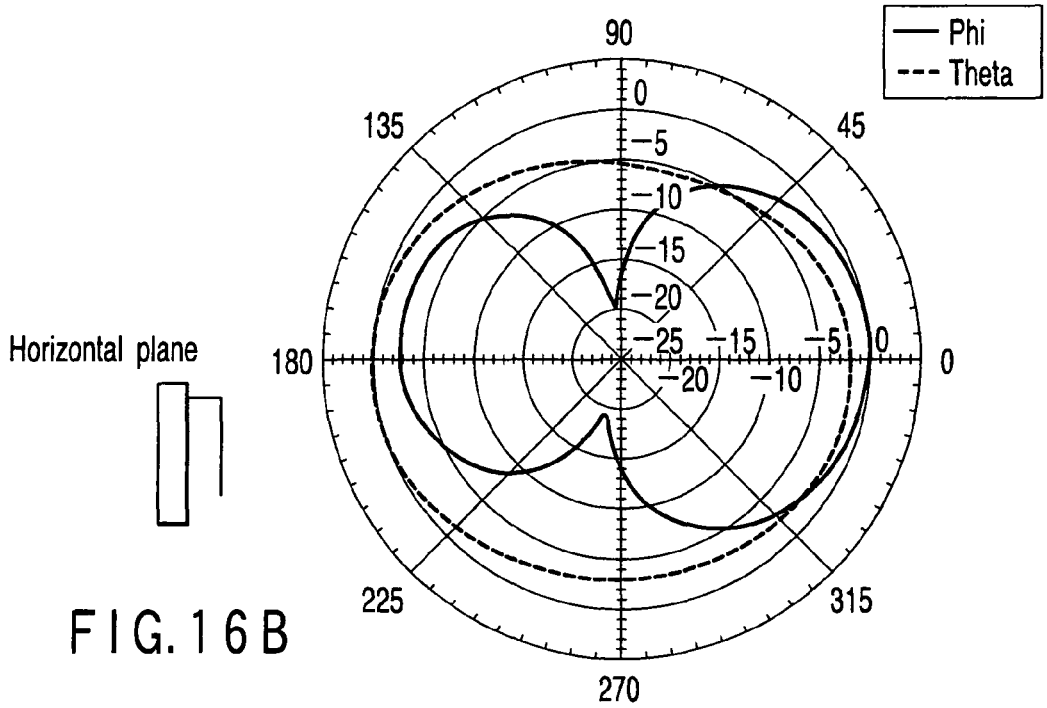
Figure 17A:
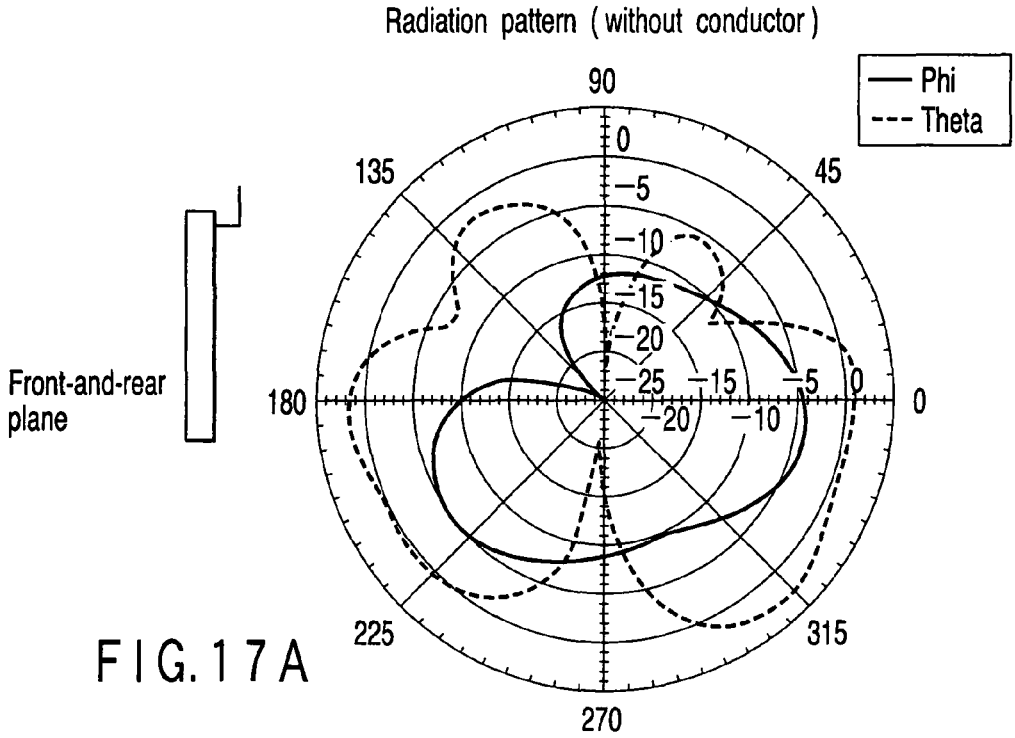
FIGS. 17A and 17B are views showing examples of radiation patterns obtained when the conductor is not mounted.
Figure 17B:
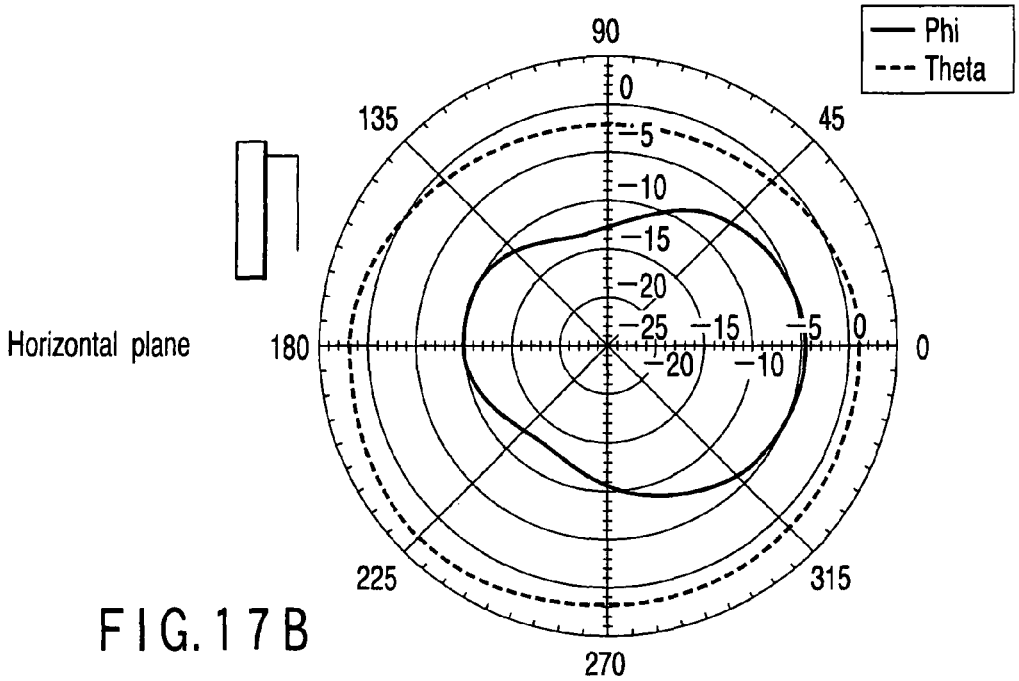

FIGS. 16A and 16B are views showing examples of radiation patterns obtained when the conductor 6 is mounted. FIGS. 16A and 16B respectively show radiation gains on the front-and-rear plane and horizontal plane of the circuit board 1. FIGS. 17A and 17B show radiation patterns obtained when the conductor 6 is not mounted. As is apparent from FIGS. 16A and 16B, when the conductor 6 is mounted, the radiation gain of the circuit board 1 is suppressed in the forward direction, and increases in the upward direction.

Figure 18:
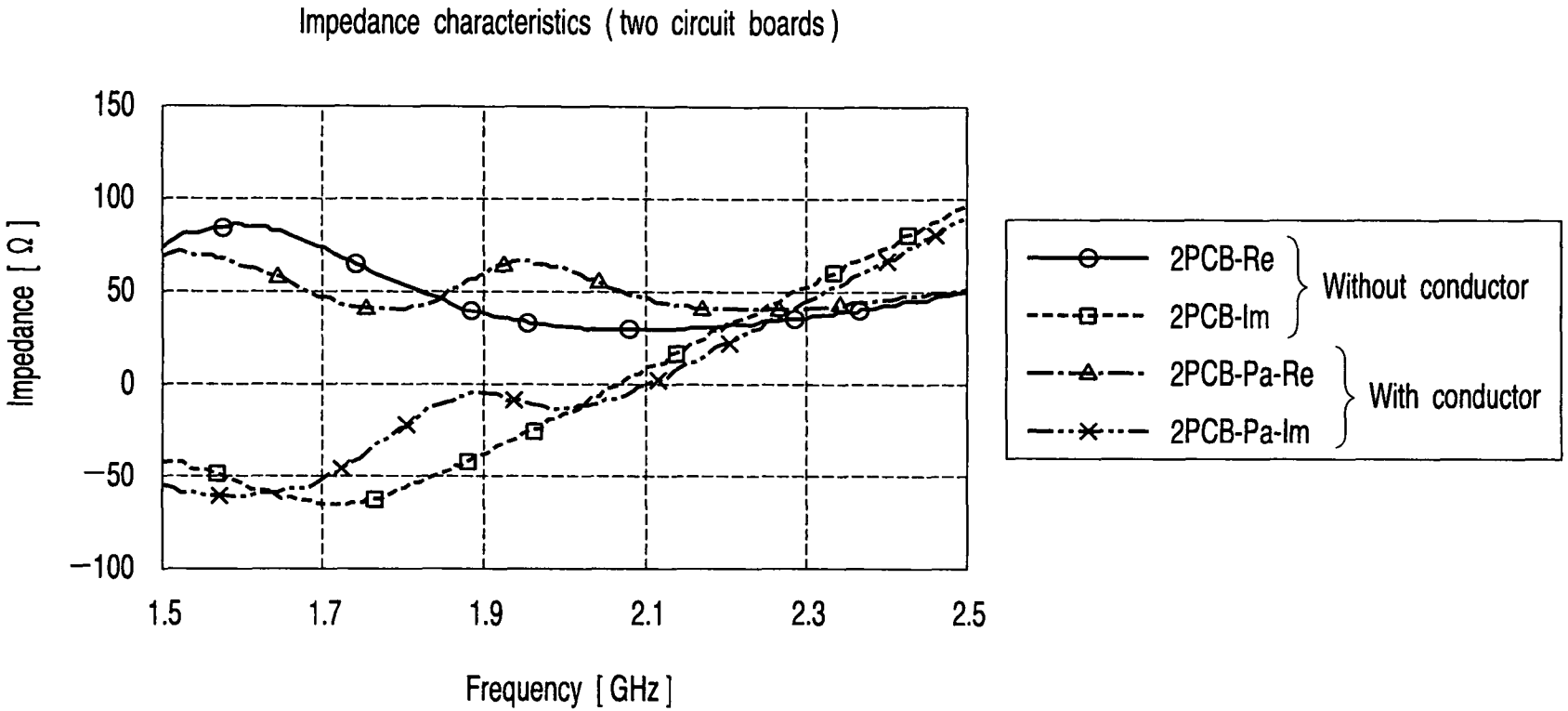
FIG. 18 is a graph showing an example of the impedance characteristics of the radio module shown in FIG. 13.

Since the conductor 6 is open from the viewpoint of the feed point even when the two circuit boards 1 and 7 are provided, the impedance increases from the viewpoint of the feed point. FIG. 18 is a graph showing an example of a change in impedance as a function of the frequency. With reference to FIG. 18, the impedance characteristics improve when the conductor 6 is mounted (2PCB-Pa-Re, 2PCB-Pa-Im) as compared with a case in which the conductor 6 is not mounted (2PCB-Re, 2PCB-Im).

Figure 19:
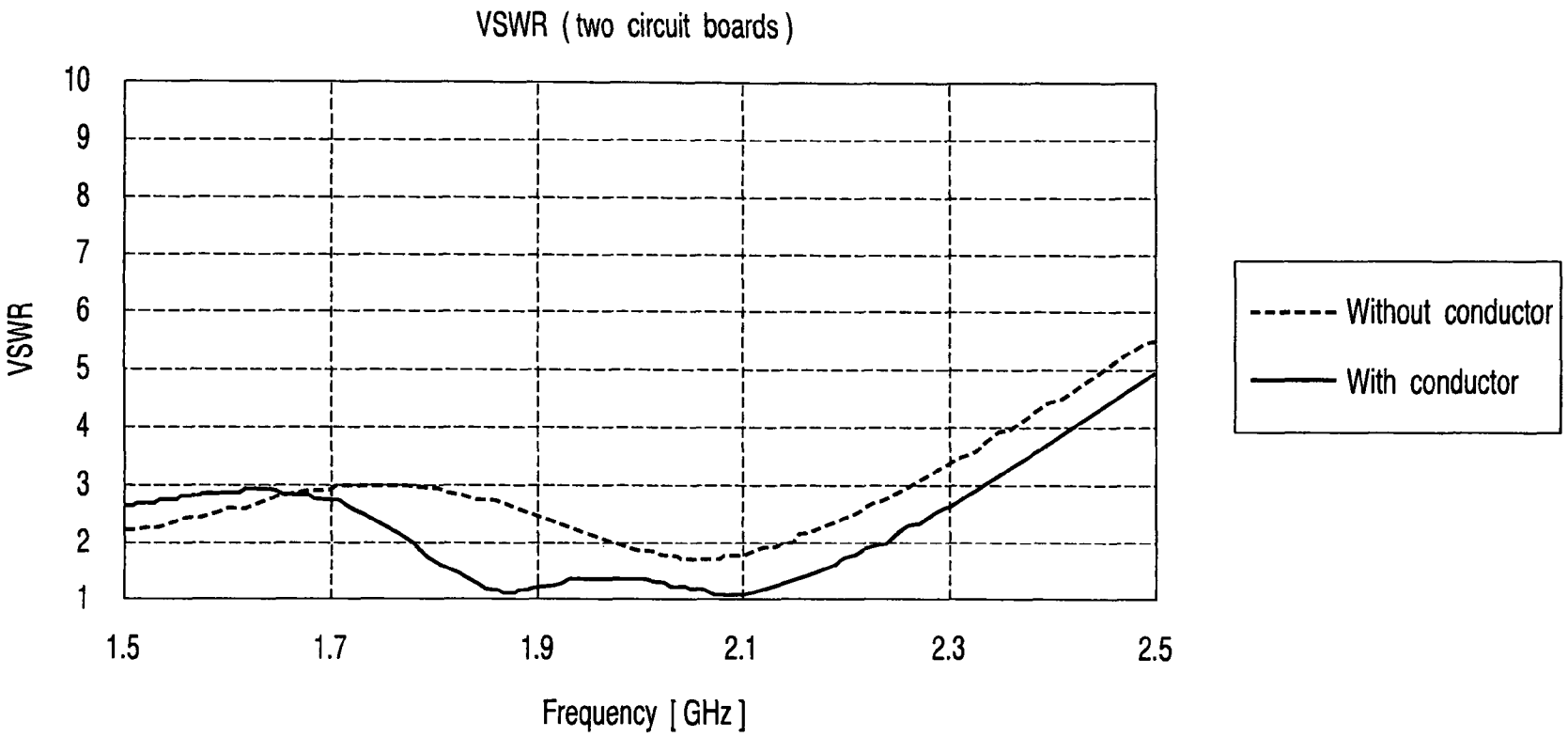
FIG. 19 is a graph showing an example of the VSWR characteristics of the radio module shown in FIG. 13.

Additionally, since many resonant modes are generated by mounting the conductor 6, the antenna becomes broadband. FIG. 19 is a graph showing an example of a change in the voltage standing wave ratio (VSWR) as a function of frequency. As is apparent from FIG. 19, the VSWR improves over a broader frequency band when the conductor 6 is mounted (solid line in FIG. 19) as compared with a case in which the conductor 6 is not mounted (broken line in FIG. 19).

In the second embodiment, the conductor 6 is also connected to the ground pattern 2 at the position spaced apart by a quarter-wavelength of the radio-frequency signal from the feed point on the radiation of a radio frequency signal generation side of the circuit board 1. Hence, the high-frequency current flowing on the ground pattern 2 along the radiation of a radio frequency signal generation side of the circuit board 1 can flow to the conductor 6 most efficiently. As a result, many resonant modes are easily generated, and the antenna becomes broadband more effectively. Note that the shorter the distance between the conductor 6 and the connector 9 is, the more effectively the radiation pattern improves.

Furthermore, in the second embodiment, the conductor 6 is also mounted on the side surface of the board along the radiation of a radio frequency signal generation side of the circuit board 1, and the proximal end of the conductor 6 is connected to the ground pattern 2 on the rear surface side of the circuit board 1. That is, the conductor 6 is mounted on the surface of the circuit board 1 opposing the surface facing the user during speech communication. The influence of the user on the conductor can be reduced as compared with the case in which the conductor 6 is located on the surface of the circuit board 1 facing the user. Note that the conductor 6 is not mounted on this circuit component mounting surface, thereby preventing an increase in size of the terminal.

Third Embodiment

According to the third embodiment of the present invention, a conductor 6 is grounded on a ground pattern 2 via an impedance adjustment circuit.

Figure 20:
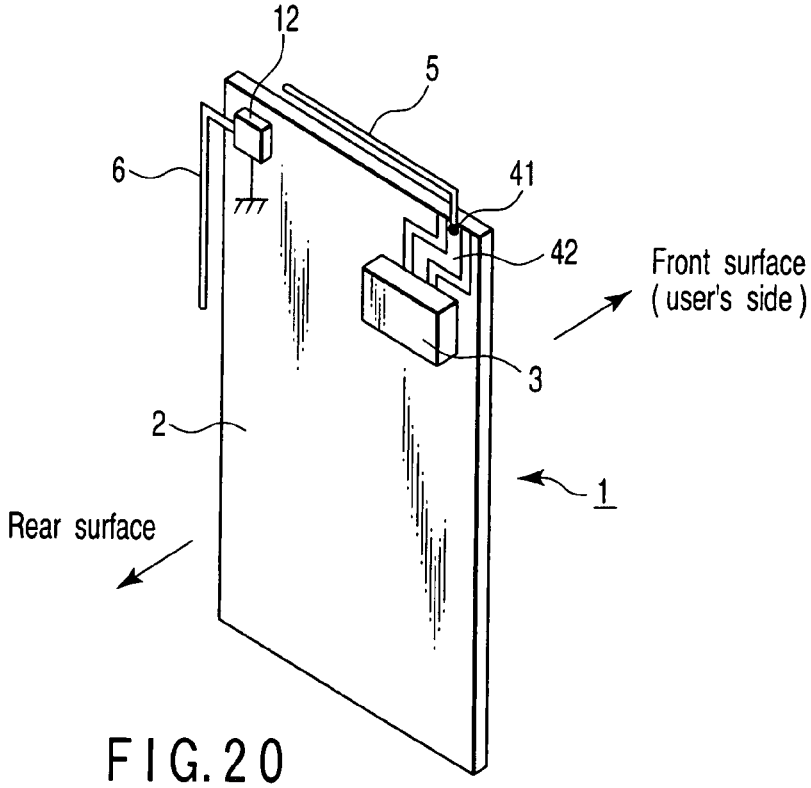
FIG. 20 is a perspective view showing the arrangement of a radio module according to the third embodiment of the present invention.

FIG. 20 is a perspective view showing the arrangement of a radio module according to the third embodiment of the present invention. Note that the same reference numbers as in FIG. 1 denote the same parts in FIG. 20, and a detailed description thereof will be omitted. An impedance adjustment circuit 12 is mounted on a radiation of a radio frequency signal generation side of a circuit board 1, at a position spaced apart by a quarter-wavelength of a radio-frequency signal from a feed point. The conductor 6 is connected to the ground pattern 2 via the impedance adjustment circuit 12.

(1) Example 1

Figure 21:
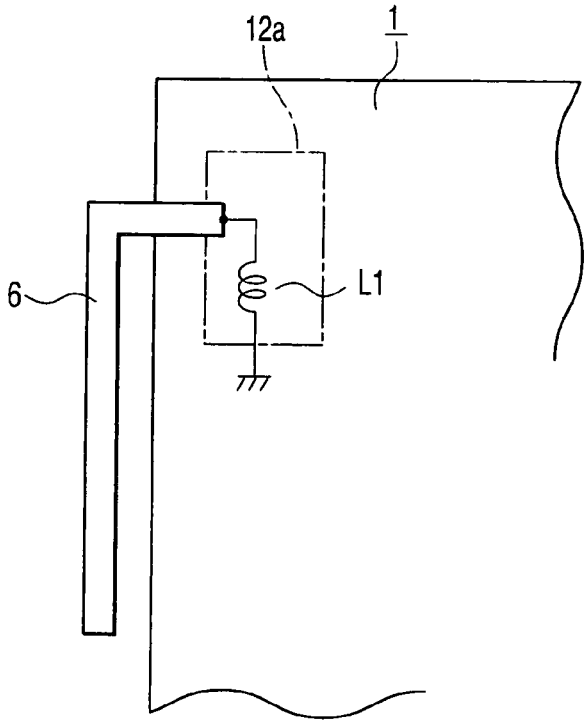
FIG. 21 is a circuit diagram showing the arrangement of the radio module shown in FIG. 20 according to the first embodiment.

As denoted by reference number 12*a* in FIG. 21, the impedance adjustment circuit 12 comprises an inductor L1. When the conductor 6 is connected to the ground pattern 2 via the inductor L1 as shown in FIG. 21, the effective electrical length from the feed point to the distal end of the conductor 6 can be made equivalently short. More specifically, the element length of the conductor 6 can be shortened, thereby downsizing the radio module by reducing the mounting space of the conductor 6.

A capacitor or variable reactance element can also serve as the impedance adjustment circuit 12. More specifically, when using the variable reactance element, a matching frequency range can be widened.

Figure 33:
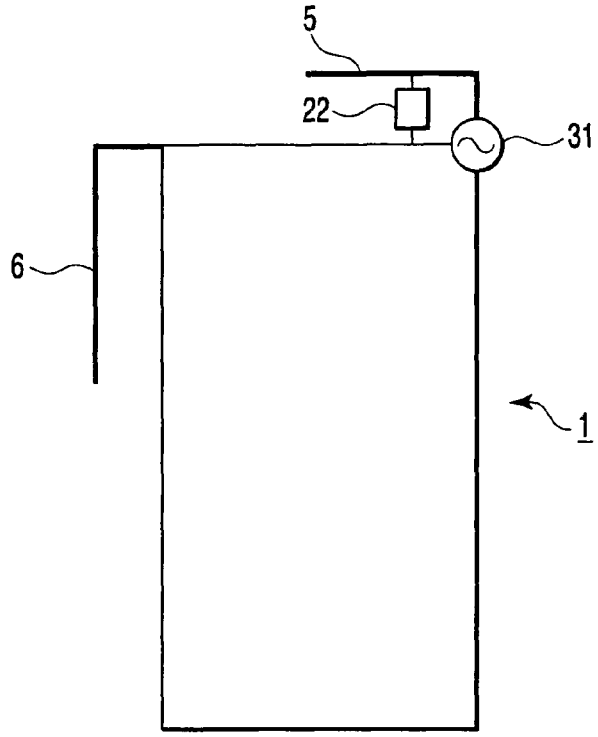
FIG. 33 is a view showing a modification of the radio module according to the third embodiment of the present invention.

Note that, as shown in FIG. 33, the intermediate portion of an antenna 5 may be connected to the ground pattern 2 via a variable reactance element 22 in place of insertion of the variable reactance element between the conductor 6 and the ground pattern 2. With this arrangement, the matching frequency range can also be widened.

(2) Example 2

Figure 22:
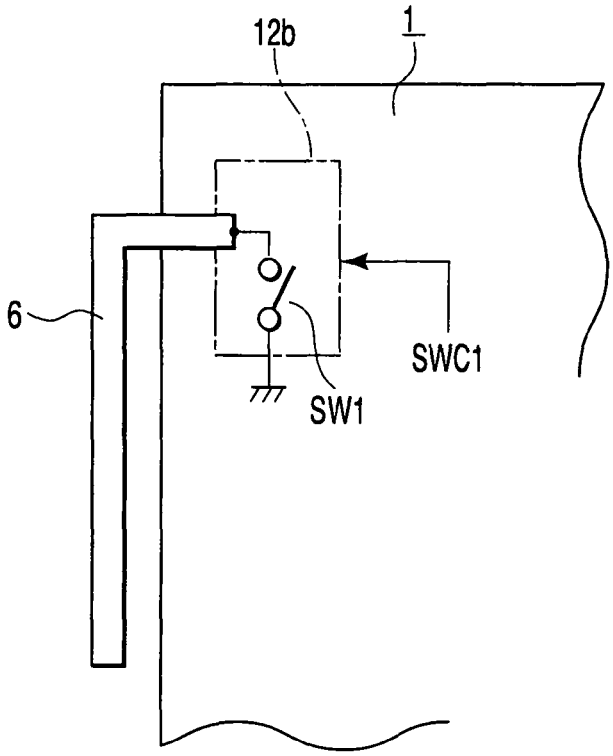
FIG. 22 is a circuit diagram showing the arrangement of the radio module shown in FIG. 20 according to the second embodiment.

As denoted by reference number 12*b* in FIG. 22, the impedance adjustment circuit 12 can also comprise a switch SW1. Switch SW1 comprises a MEMS, PIN diode, metal oxide semiconductor FET (MOSFET), or the like, and is opened or closed in accordance with a switching control signal SWC1 output from a control circuit (not shown) in the portable terminal.

The control circuit outputs the switching control signal SWC1 in accordance with the operation mode of the portable terminal. For example, when the portable terminal operates in a speech communication mode, the control circuit outputs the switching control signal SWC1 to close switch SW1. On the other hand, when the portable terminal operates in a data communication mode such as a mail transmission/reception mode or web access mode, the control circuit outputs the switching control signal SWC1 to open switch SW1.

With this arrangement, when the portable terminal operates in the speech communication mode, switch SW1 is closed, and the conductor 6 is connected to the ground pattern 2. Hence, as described in the first embodiment, the radiation gain in the forward direction is suppressed. Accordingly, the influence of the user's head on the radiation gain can be reduced even when the user's head is in contact with or close to the portable terminal in speech communication.

On the other hand, in the data communication mode such as the mail transmission/reception mode or web access mode in which the radio module is not used in contact with or close to the user's head, switch SW1 is opened, and the conductor 6 is disconnected from the ground pattern 2. That is, the portable terminal operates without the conductor 6. As a result, the directivity of the radiation pattern can become uniform, thereby obtaining efficient radiation.

Fourth Embodiment

According to the fourth embodiment of the present invention, a circuit board 1 includes a plurality of radio circuits and antennas, and one of the antennas can serve as a conductor.

Figure 23:
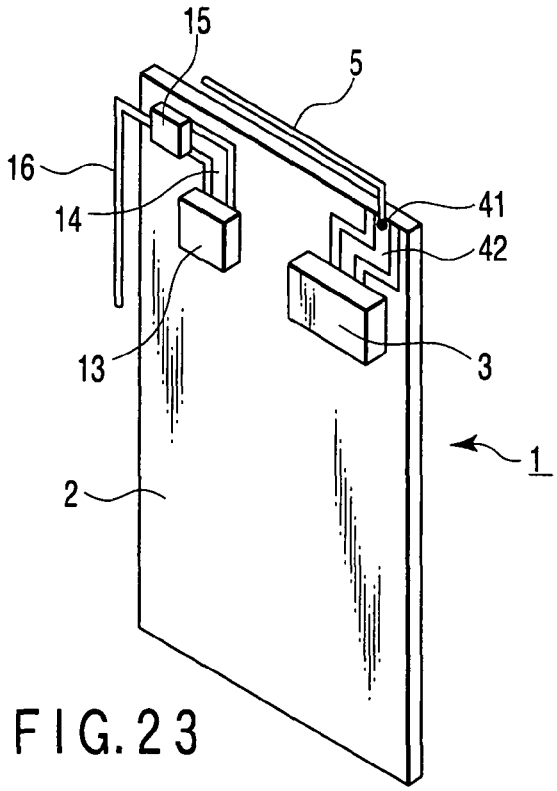
FIG. 23 is a perspective view showing the arrangement of a radio module according to the fourth embodiment of the present invention.

FIG. 23 is a perspective view showing the arrangement of a radio module according to the fourth embodiment of the present invention. Note that the same reference numbers as in FIG. 1 denote the same parts in FIG. 23, and a detailed description thereof will be omitted. On the rear surface of the circuit board 1, a second radio circuit 13 is mounted in addition to a first radio circuit 3 and an antenna 5. A connection circuit 15 is connected to the second radio circuit 13 via a signal line pattern 14, and a second antenna 16 is connected to the connection circuit 15.

(1) Example 1

In Example 1, the first antenna 5 and the second antenna 16 are used for different radio systems.

Figure 24:
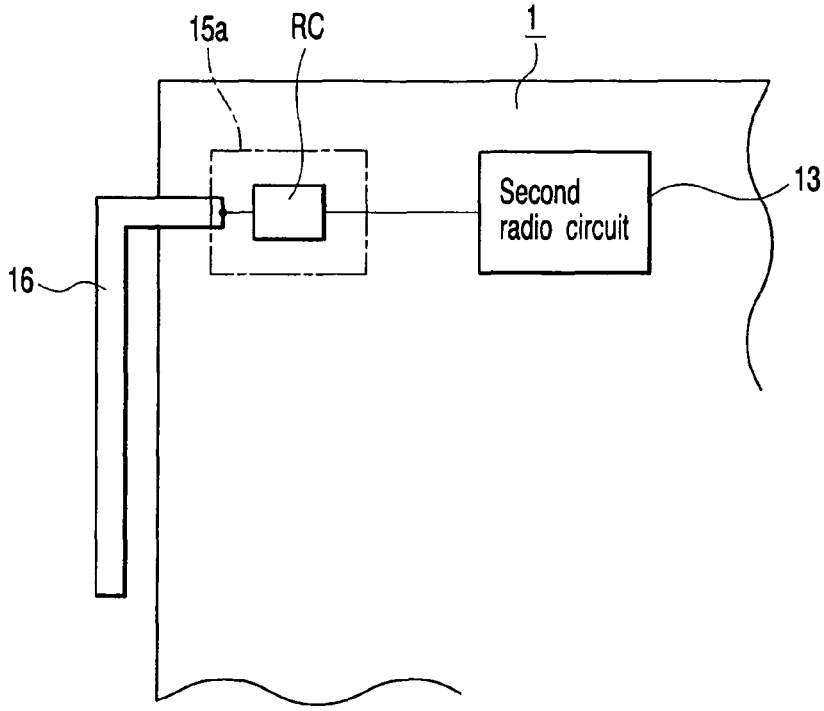
FIG. 24 is a circuit diagram showing the arrangement of the radio module shown in FIG. 23 according to the first embodiment.

The second antenna 16 is mounted at a position spaced apart by a quarter-wavelength from the feed point of the first antenna 5, on a radiation of a radio frequency signal generation side when performing radio transmission by the first antenna 5. The connection circuit 15 comprises a variable reactance element RC denoted by reference number 15*a* in FIG. 24.

With this arrangement, in, e.g., a reception period of a portable terminal, the second antenna 16 serves as a diversity reception antenna for transmitting a radio-frequency signal to the second radio circuit 13, and serves as a conductor 6 to improve the radiation characteristics or the like of the first antenna 5 in a transmission period. That is, the second antenna 16 also serves as the conductor 6. Accordingly, the effect of the present invention can be obtained without additionally using the conductor 6. Also, when inserting the variable reactance element RC and the consistent circuit, a matching frequency range can be widened.

Figure 34:
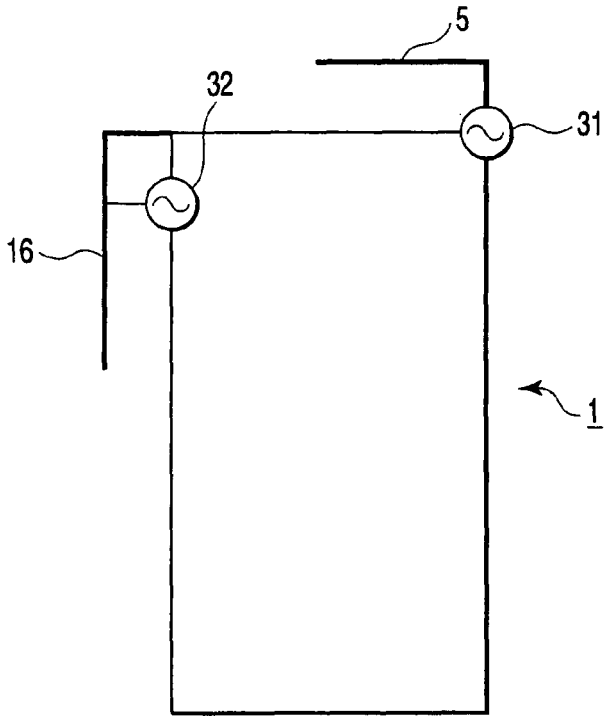
FIG. 34 is a view showing a modification of the radio module according to the fourth embodiment of the present invention.

Note that as shown in FIG. 34, a predetermined intermediate position of the second antenna 16 may be connected to a feed point 32 of the second radio circuit 13, and the proximal end of the second antenna 16 may be grounded on a ground pattern 2 of the circuit board 1. With this arrangement, the second antenna 16 can also serve as the conductor 6.

(2) Example 2

In Example 2, the first radio circuit 3 and the antenna 5 are used for mobile communication, and the second radio circuit 13 and the antenna 16 are used for local data communication such as a wireless local area network (LAN), Bluetooth®, or ultra-wideband (UWB).

Figure 25:
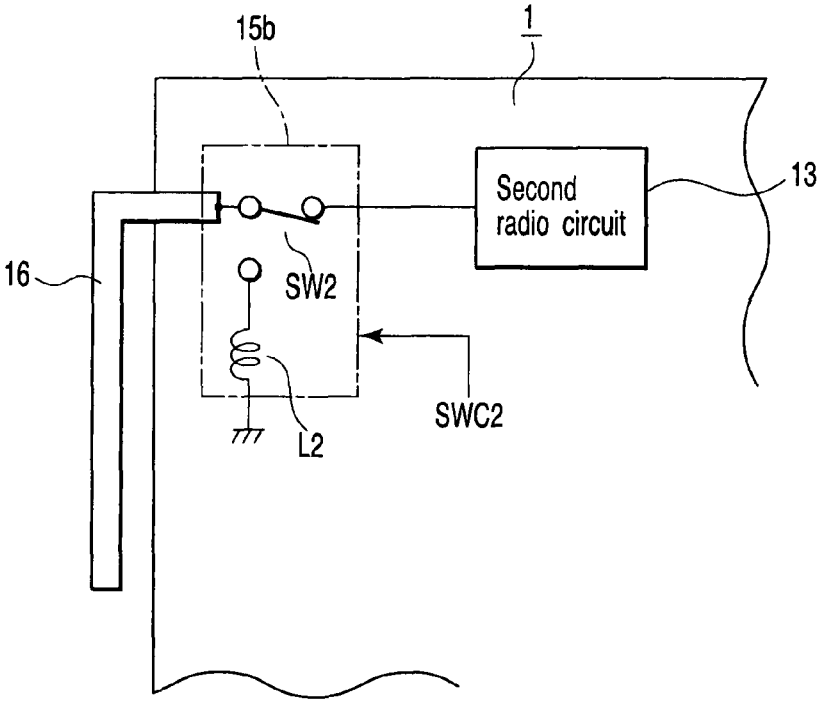
FIG. 25 is a circuit diagram showing the arrangement of the radio module shown in FIG. 23 according to the second embodiment.

The second antenna 16 is mounted at a position spaced apart by a quarter-wavelength of a radio-frequency signal from the feed point of the first antenna 5, along a radiation of a radio frequency signal generation side when performing radio transmission by using the first antenna 5. As denoted by reference number RC in FIG. 25, the connection circuit 15*b* comprises a switch SW2 and an inductor L2. Switch SW2 comprises a semiconductor switch or the like, and selectively connects the proximal end of the second switch element 16 to the second radio circuit 13 and the ground pattern 2 in accordance with a switching control signal SWC2 output from a control circuit (not shown) of the portable terminal. Note that the inductor L2 is inserted between the proximal end of the second switch element 16 and the ground pattern 2 when the second switching element 16 is to be grounded.

The control circuit outputs the switching control signal SWC2 to connect switch SW2 to the second radio circuit 13 in the local data communication period in accordance with the operation mode of the portable terminal. On the other hand, in a mobile communication transmission period, the control circuit outputs the switching control signal SWC2 to connect switch SW2 to the ground pattern.

With this arrangement, for example, in the local data communication period for transmitting audio data to an earphone unit (not shown), switch SW2 is switched to the radio circuit 13 side, and connected to the second radio circuit 13. Hence, a local data communication transmission signal output from the second radio circuit 13 is wirelessly transmitted via the second antenna 16.

On the other hand, when speech communication is to be performed by mobile communication, switch SW2 is switched to the ground pattern 2 side, and connected to the ground pattern 2 via the inductor L2. At this time, the ground position of the second switching element 16 is set at a position spaced apart by a quarter-wavelength of the radio-frequency signal for mobile communication from the feed point of the first antenna 5. Accordingly, as described in the first embodiment and the like, the current flowing to the ground pattern 2 partially flows to the second antenna 16, thereby reducing the current flowing to the ground pattern 2. Accordingly, the radiation gain in the forward direction (toward the user's head) of the terminal can be suppressed.

As a result, the influence of the user' head on the radiation gain can be reduced even when the user's head is in contact with or close to the portable terminal for speech communication. Similar to the first embodiment, the impedance characteristics can be improved, and the bandwidth can be widened. Since the second antenna 16 is grounded via the inductor L2, the impedance of the second antenna 16 can be adjusted to an optimal value.

That is, the second antenna 16 for the local data communication can also serve as the conductor 6 for mobile communication. Since the second antenna 16 serves as the conductor 6, no separate conductor need be used, thereby preventing an increase in size of the radio module and the portable terminal.

Fifth Embodiment

According to the fifth embodiment of the present invention, in a radio module such as a radio module installed in a foldable portable terminal in which two circuit board units are connected via a flexible cable or thin coaxial cable, a plurality of pairs of radio circuits and antennas are arranged in one circuit board unit, and one of the antennas can be used as the conductor.

Figure 26:
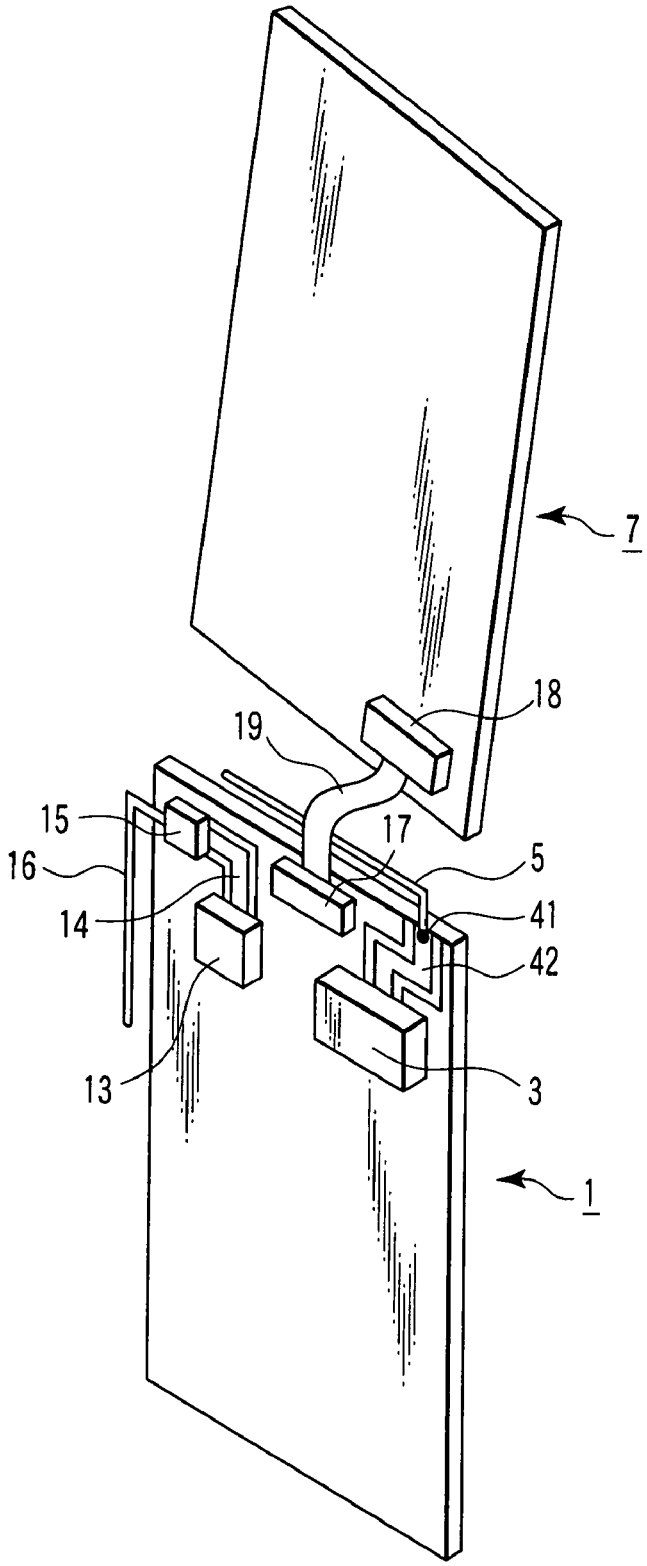
FIG. 26 is a perspective view showing the arrangement of a radio module according to the fifth embodiment of the present invention.

FIG. 26 is a perspective view showing the arrangement of the radio module according to the fifth embodiment of the present invention. Note that the same reference numbers as shown in FIGS. 1 and 23 denote the same parts in FIG. 26, and a detailed description thereof will be omitted.

In the radio module according to this embodiment, a first circuit board 1 accommodated in a lower housing and a second circuit board 7 accommodated in an upper housing of the portable terminal are connected to each other via a flexible cable 19 and connectors 17 and 18. On the rear surface of the first circuit board 1 of the circuit boards 1 and 7, a second radio circuit 13 is mounted in addition to a first radio circuit 3 and an antenna 5. A connection circuit 15 is connected to the second radio circuit 13 via a signal line pattern 14, and a second antenna 16 is connected to the connection circuit 15.

In the connection circuit 15, the second antenna 16 may be connected to the radio circuit 13 by using a variable reactance element RC, inductor, capacitor, or the like as described in the fourth embodiment, or the second antenna 16 may be selectively connected to the second radio circuit 13 and a ground pattern 2 in accordance with the communication mode of the portable terminal by using a switch SW2.

In this embodiment, in the radio module having two circuit board units, the second antenna 16 functions as a conductor 6 similar to the fourth embodiment. As a result, the radiation characteristics and impedance characteristics can be improved and the bandwidth is widened. Additionally, since the second antenna 16 is also used as the conductor 6, no separate conductor need be additionally used, thereby preventing an increase in size of the radio module and the portable terminal.

Other Embodiments

Figure 27:
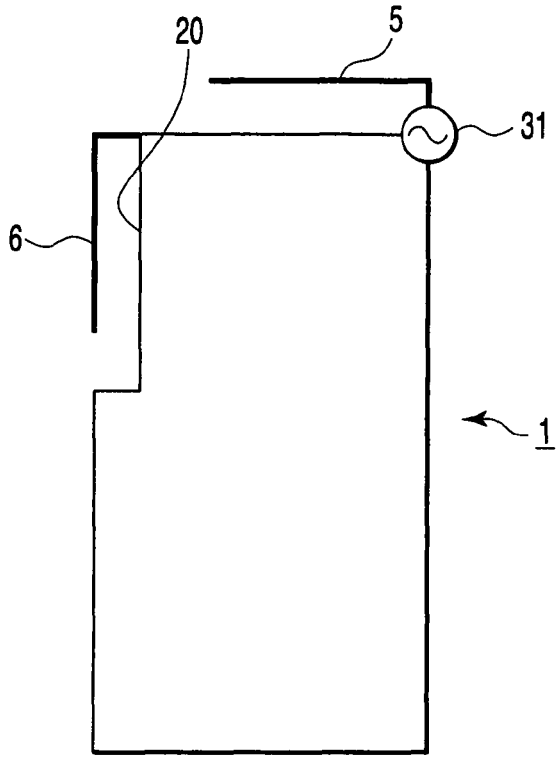
FIG. 27 is a view showing the first example of a radio module according to another embodiment of the present invention.

Various modifications of the arrangement, ground position, and ground structure of a conductor 6 may be made. For example, as shown in FIG. 27, a cutout 20 may be formed on a circuit board 1, and the conductor 6 may be inserted in the cutout 20. With this arrangement, the conductor 6 does not project from the side surface of the circuit board 1.

Figure 28:
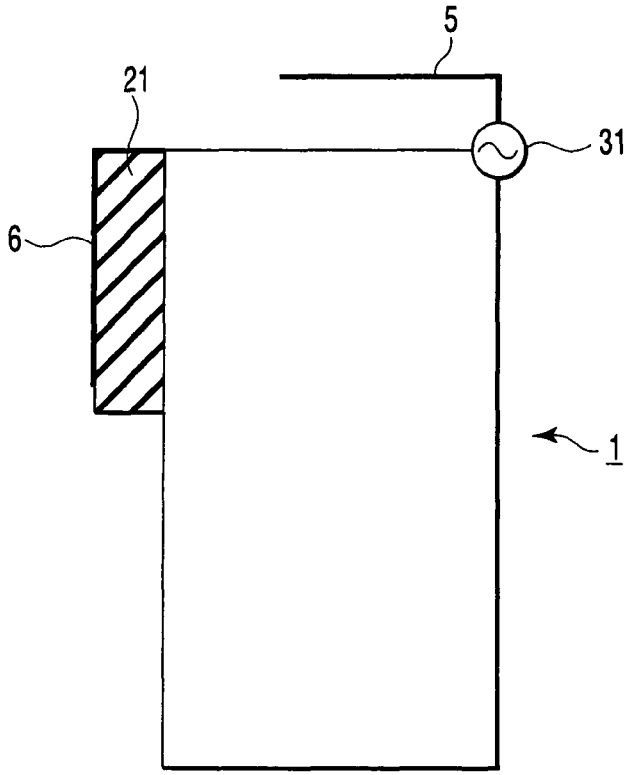
FIG. 28 is a view showing the second example of a radio module according to still another embodiment of the present invention.

As shown in FIG. 28, a magnetic member 21 is inserted between the conductor 6 and the circuit board 1. With this arrangement, the conductor 6 can be downsized. When using a magnetic material having high magnetic permeability, the space between the conductor 6 and the circuit board 1 need not be large, thereby downsizing the radio module. Note that a dielectric member can be used in place of the magnetic member 21.

Figure 29:
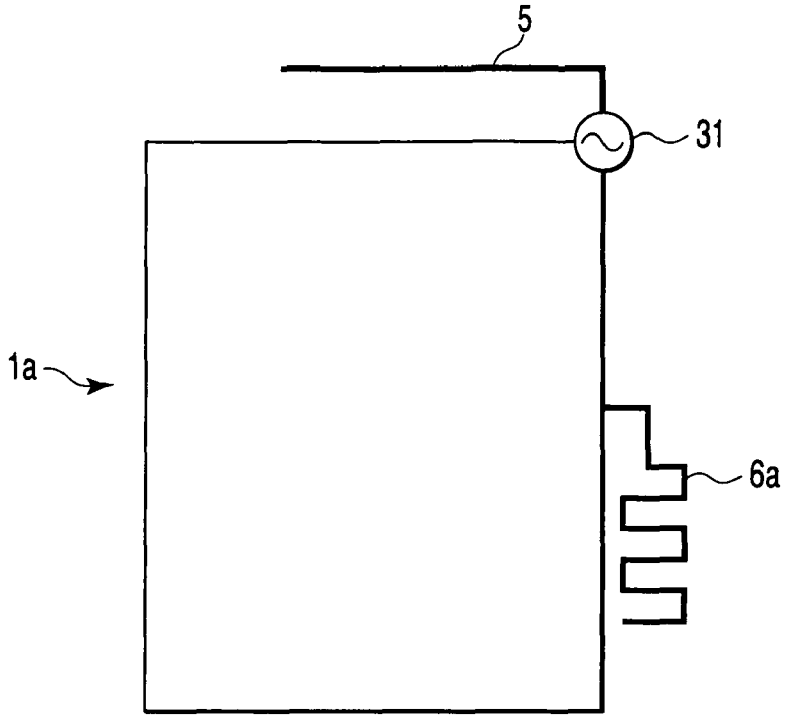
FIG. 29 is a view showing the third example of a radio module according to still another embodiment of the present invention.
Figure 30:
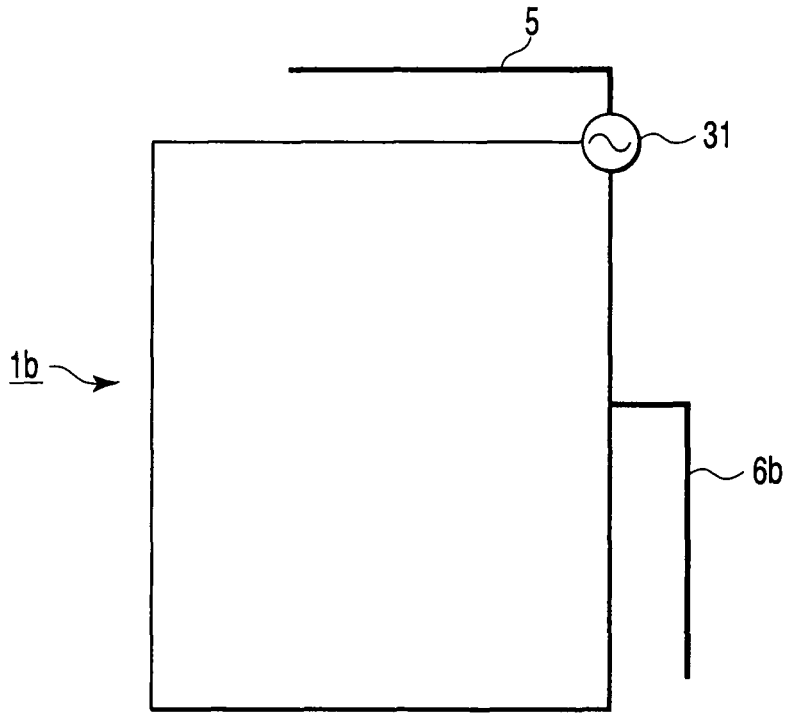
FIG. 30 is a view showing the fourth example of a radio module according to still another embodiment of the present invention.
Figure 31:
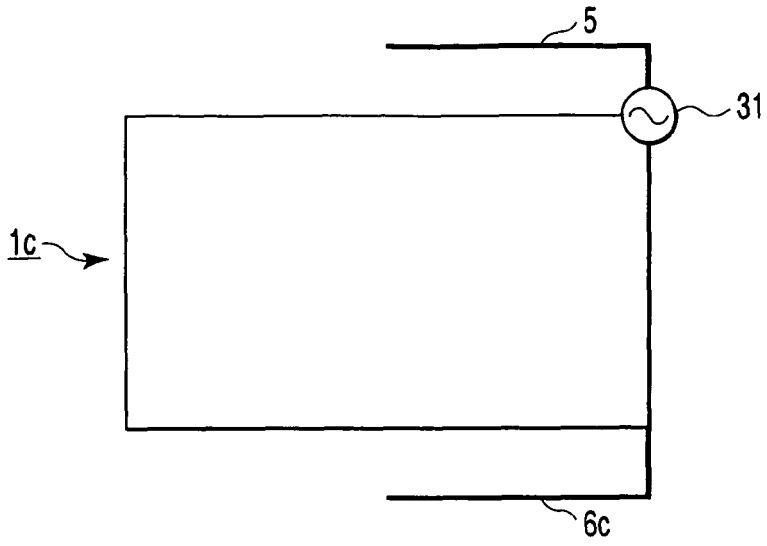
FIG. 31 is a view showing the fifth example of a radio module according to still another embodiment of the present invention.
Figure 32:
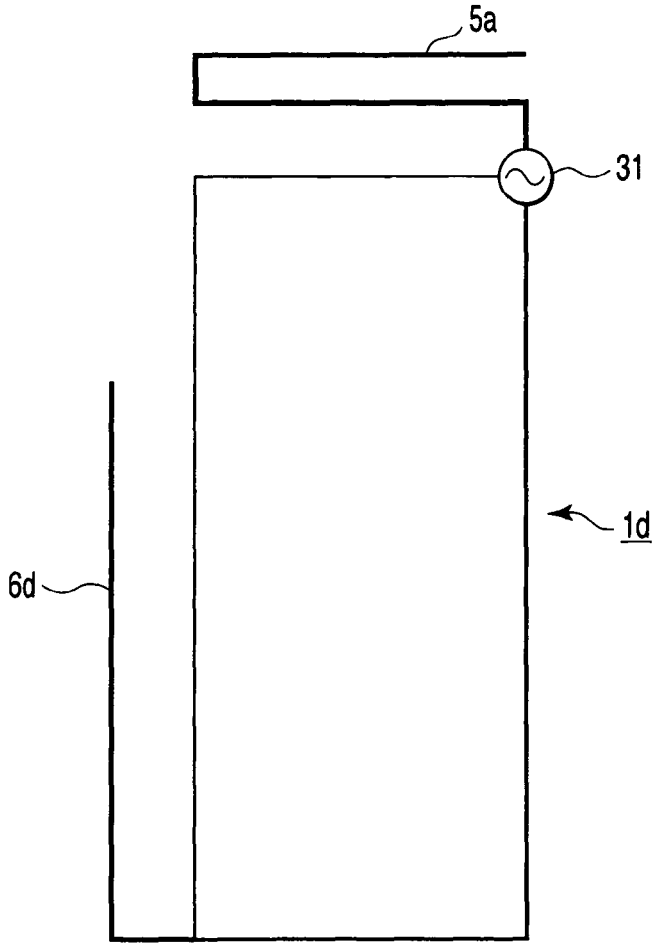
FIG. 32 is a view showing the sixth example of a radio module according to still another embodiment of the present invention.
Figure 35:
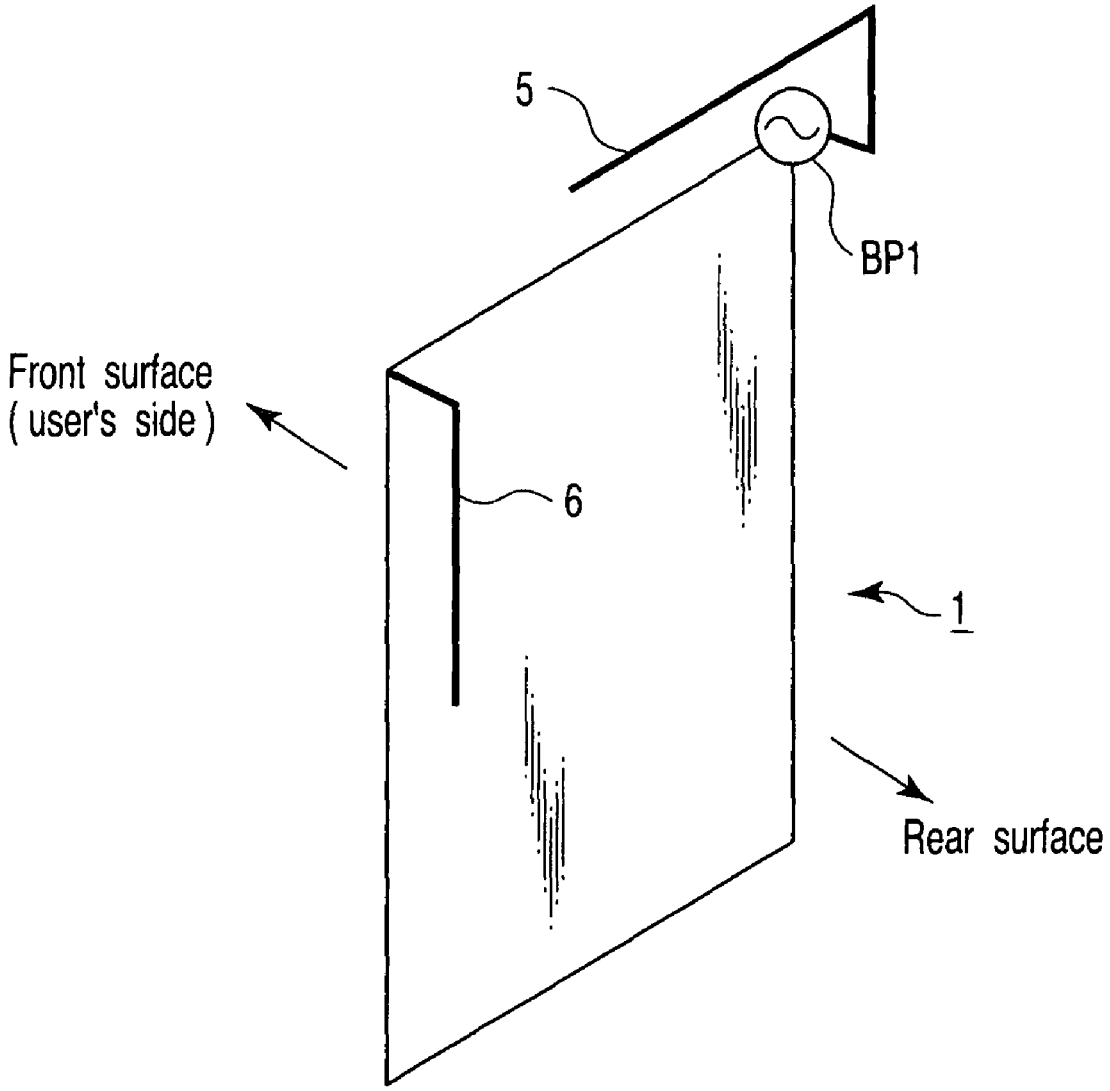
FIG. 35 is a view showing the seventh example of a radio module according to still another embodiment of the present invention.

As denoted by reference numbers 6*a*, 6*b*, and 6*c* in FIGS. 29 to 31, the ground position of the conductor may be set on a side near a feed point 31 of an antenna 5, or on the rear surface of the circuit board 1 as shown in FIG. 35. For example, the conductor 6 may be entirely or partially meander line or zigzag as denoted by a reference number 6*a* in FIG. 29. With this arrangement, a necessary effective electrical length can be ensured even when a long conductor cannot be mounted in a mounting space. Assume that a long conductor needs to be located in correspondence with a meander line or zigzag antenna 5*a* as shown in FIG. 32. In this case, when the length of the side along which a conductor 6*d* is mounted is sufficiently long on a circuit board 1*d*, the long conductor 6*d* may be directly mounted along the side of the circuit board 1*d*.

The ground position of the conductor 6 on the circuit board 1 is not limited to the position spaced apart by a quarter-wavelength of the radio-frequency signal from the feed point 31. The conductor 6 may be mounted at any position in the vicinity of that position. Also, the effective electrical length from the feed point 31 to the distal end of the conductor 6 is not limited to a half-wavelength of the radio-frequency signal. The effective electrical length may be set to be any length near that length.

Additionally, the shape and size of the circuit board, the arrangement and mounting position of the conductor, the frequency of the radio-frequency signal by the radio module, and the type of the portable terminal can be variously modified without departing from the spirit and scope of the invention.

Note that the present invention is not limited to the above embodiments, and can be variously modified and implemented without departing from the spirit and scope of the invention upon practice. Various inventions can be achieved by an appropriate combination of building components disclosed in the embodiments. For example, several building components may be omitted from all the building components described in the embodiments. Further, building components in different embodiments may be properly combined.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A radio module in which a radio circuit is mounted on a circuit board having a ground pattern, the radio module comprising:

an antenna connected to the radio circuit; and a conductor located at a position facing a second surface opposing a first surface facing a user or a side surface of the circuit board, in which a radiation of a radio frequency signal is generated, and configured to partially shunt a current flowing to the ground pattern of the circuit board, wherein a proximal end of the conductor is connected to the ground pattern at or near a position spaced apart by a quarter-wavelength of a radio-frequency signal by the antenna from a connection point between the radio circuit and the antenna.

2. The radio module according to claim 1, further comprising an impedance adjustment circuit located between the proximal end of the conductor and the ground pattern of the circuit board, and configured to adjust an impedance of the conductor from the viewpoint of the connection point between the radio circuit and the antenna.

3. The radio module according to claim 2, wherein the impedance adjustment circuit includes an inductor which connects the proximal end of the conductor with the ground pattern of the circuit board in series.

4. The radio module according to claim 2, wherein the impedance adjustment circuit includes a variable reactance element which connects the proximal end of the conductor with the ground pattern of the circuit board in series.

5. The radio module according to claim 1, further comprising a switch located between the proximal end of the conductor and the ground pattern of the circuit board, and configured to switch between a state in which the conductor is connected to the ground pattern and a state in which the conductor is disconnected from the ground pattern, in accordance with an operation mode required by the radio module.

6. The radio module according to claim 5, wherein the switch is closed in a communication mode to connect the proximal end of the conductor with the ground pattern of the circuit board, and opened in a data communication mode to disconnect the proximal end of the conductor from the ground pattern of the circuit board.

7. The radio module according to claim 1, wherein the conductor is at least partially meander line or zigzag over a total length.

8. A radio module in which a radio circuit is mounted on a circuit board having a ground pattern, the radio module comprising:

an antenna connected to the radio circuit; and a conductor located at a position facing a second surface opposing a first surface facing a user or a side surface, along a side of the circuit board, in which a radiation of a radio frequency signal is generated, and configured to partially shunt a current flowing to the ground pattern of the circuit board, wherein a distal end of the conductor is open, and a proximal end of the conductor is connected to the ground pattern at a position at which an effective electrical length from a connection point between the radio circuit and the antenna to the distal end is set to be a half-wavelength of a radio-frequency signal by the antenna or an approximate value of the half-wavelength.

9. The radio module according to claim 8, further comprising an impedance adjustment circuit located between the proximal end of the conductor and the ground pattern of the circuit board, and configured to adjust an impedance of the conductor from the viewpoint of the connection point between the radio circuit and the antenna.

10. The radio module according to claim 9, wherein the impedance adjustment circuit includes an inductor which connects the proximal end of the conductor with the ground pattern of the circuit board in series.

11. The radio module according to claim 9, wherein the impedance adjustment circuit includes a variable reactance element which connects the proximal end of the conductor with the ground pattern of the circuit board in series.

12. The radio module according to claim 8, further comprising a switch located between the proximal end of the conductor and the ground pattern of the circuit board, and configured to switch between a state in which the conductor is connected to the ground pattern and a state in which the conductor is disconnected from the ground pattern, in accordance with an operation mode required by the radio module.

13. The radio module according to claim 12, wherein the switch is closed in a communication mode to connect the proximal end of the conductor with the ground pattern of the circuit board, and opened in a data communication mode to disconnect the proximal end of the conductor from the ground pattern of the circuit board.

14. A radio module in which a first radio circuit and a second radio circuit are mounted on a circuit board having a ground pattern, the radio module comprising:

a first antenna connected to the first radio circuit;

a second antenna connected to the second radio circuit; and a connection circuit located between the second radio circuit and the second antenna, wherein the second antenna is located along a side of the circuit board, in which a radiation of a radio frequency signal is generated, if performing radio transmission using the first antenna, and located at or near a position spaced apart by a quarter-wavelength of a radio-frequency signal by the first antenna from a connection point between the first antenna and the first radio circuit.

15. The radio module according to claim 14, wherein the connection circuit includes a variable reactance element.

16. A radio module in which a first radio circuit operating in a first period and a second radio circuit operating in a second period different from the first period are mounted on a circuit board having a ground pattern, the radio module comprising:

a first antenna connected to the first radio circuit;

a second antenna located at a position facing a second surface opposing a first surface facing a user or a side surface, along a side of the circuit board, in which a radiation of a radio frequency signal is generated, in the first period, and connected to the second radio circuit; and a connection switching circuit inserted between the second radio circuit and the second antenna, wherein the connection switching circuit connects, in the second period, the second antenna to the second radio circuit, and connects, in the first period, the second antenna to the ground pattern at or near a position spaced apart by a quarter-wavelength of a radio-frequency signal by the first antenna from a connection point between the first radio circuit and the first antenna.

17. The radio module according to claim 16, wherein the connection switching circuit includes a switch and an inductor, and the switch directly connects, in the second period, the second antenna to the second radio circuit, and connects, in the first period, the second antenna to the ground pattern via the inductor at or near a position spaced apart by the quarter-wavelength of the radio-frequency signal by the first antenna from the connection point between the first radio circuit and the first antenna.

* * * * *